US007495683B2

(12) United States Patent
Takata et al.

(10) Patent No.: US 7,495,683 B2
(45) Date of Patent: Feb. 24, 2009

(54) IMAGE FORMING APPARATUS AND CONTROL METHOD THEREFOR

(75) Inventors: Shinichi Takata, Abiko (JP); Akihiko Sakai, Abiko (JP); Takuya Kawamura, Tokyo (JP); Yuichiro Maeda, Kashiwa (JP)

(73) Assignee: Canon Kabushiki Kaisha (JP)

( * ) Notice: Subject to any disclaimer, the term of this patent is extended or adjusted under 35 U.S.C. 154(b) by 118 days.

(21) Appl. No.: 11/456,683

(22) Filed: Jul. 11, 2006

(65) Prior Publication Data

US 2007/0144362 A1 Jun. 28, 2007

(30) Foreign Application Priority Data

Jul. 12, 2005 (JP) ..... 2005-203633
Jul. 12, 2005 (JP) ..... 2005-203634

(51) Int. Cl.
*B41J 2/385* (2006.01)

(52) U.S. Cl. ..... 347/116

(58) Field of Classification Search ..... 347/111–118, 347/229, 234–235, 248–250
See application file for complete search history.

(56) References Cited

U.S. PATENT DOCUMENTS 5,740,492 A * 4/1998 Deki et al. ..... 399/66
7,209,159 B2 * 4/2007 Hamano et al. ..... 347/249

FOREIGN PATENT DOCUMENTS

JP 6-289684 A 10/1994
JP 9-54504 A 2/1997
JP 2000-66562 A 3/2000
JP 2001-201994 A 7/2001
JP 2004-240306 A 8/2004

* cited by examiner

*Primary Examiner*—Luu Matthew
*Assistant Examiner*—Justin Seo
(74) *Attorney, Agent, or Firm*—Rossi, Kimms & McDowell LLP

(57) ABSTRACT

An image forming apparatus which is capable of forming an excellent image while suppressing reduction in productivity to a minimum even when an abnormality occurs in detection of an HP mark on an intermediate transfer member. When there occurs abnormality in detection of any of HP marks, an alternate signal is generated in place of a signal associated with a mark the detection of which is determined to be abnormal, and image formation is carried out with reference to the time of normal HP mark detection and the alternate signal.

5 Claims, 23 Drawing Sheets

IMAGE FORMING APPARATUS AND CONTROL METHOD THEREFOR

BACKGROUND OF THE INVENTION

1. Field of the Invention

The present invention relates to an image forming apparatus and a control method therefor, and more particularly to a technique of controlling image formation timing in image formation performed using an intermediate transfer member.

2. Description of the Related Art

Conventionally, image forming apparatuses, such as copying machines and printers, utilizing electrophotography include ones which perform image formation using a belt-like intermediate transfer member (hereinafter referred to as "the intermediate transfer belt"). In general, in an image forming apparatus of this type, electrostatic latent images formed on respective photosensitive members are developed by toner to be visualized, and the toner images are transferred onto the intermediate transfer belt, followed by being collectively transferred onto a recording material (such as a sheet). This transfer method is generally called the intermediate transfer method.

In a full-color image forming apparatus employing the above-mentioned intermediate transfer method, toner images in respective different colors, such as four colors of Y (yellow), M (magenta), C (cyan), and K (black), are transferred onto an intermediate transfer belt in a manner superimposed one upon another to thereby form a color image. In one method for achieving superimposition of colors with high accuracy to thereby obtain an excellent image, an HP mark indicative of a reference position (hereinafter referred to as "the HP (home position)") is marked on an intermediate transfer belt for detection by a sensor, and timing for starting color-specific image formation is determined based on time at which the HP mark is detected.

FIG. 11 is a schematic view of an intermediate transfer member. As shown in FIG. 11, on the inner peripheral surface of the intermediate transfer member 205, there are marked a first HP mark 1101 and a second HP mark 1102 each indicative of a reference positions (HP) at respective locations diametrically opposed to each other. Further, within the intermediate transfer member 205, there is disposed a mark sensor 1103 that detects the first HP mark 1101 and the second HP mark 1102.

As the intermediate transfer member 205 is rotated in a direction indicated by an arrow in FIG. 11, the mark sensor 1103 detects each of the first HP mark 1101 and the second HP mark 1102 once whenever the intermediate transfer member 205 performs one rotation.

In the case of forming a full-color image by this image forming apparatus, when the mark sensor 1103 detects the first HP mark 1101 after the apparatus has entered a state capable of image formation, a first-page yellow image forming process (formation of a latent image, development of the latent image by toner, and primary transfer of the toner image onto the intermediate transfer member (ditto for the other colors)) is started. Then, when the mark sensor 1103 detects the second HP mark 1102, a second-page yellow image forming process is started.

Next, when the mark sensor 1103 detects the first HP mark 1101, a first-page magenta image forming process is started, and when the mark sensor 1103 detects the second HP mark 1102, a second-page magenta image second-page magenta image forming process is started. Further, cyan image forming processes and black image forming processes are sequentially carried out in the same manner as described above, whereby first-page and second-page toner images in the respective colors are respectively primarily transferred onto the intermediate transfer member in superimposed relation.

That is, during a time period between detection of the first HP mark on the intermediate transfer member and detection of the second HP mark on the same, a first-page toner image in a color is formed on the intermediate transfer member, and during a time period between detection of the second HP mark and detection of the first HP mark, a second-page toner image in the color is formed on the intermediate transfer member.

In this type of image forming apparatus, images corresponding to respective two pages are formed with reference to time of detection of the first HP mark and the second HP mark, as described above. For this reason, when at least one of the HP marks is stained or peeled off and HP mark cannot be normally detected, excellent image formation is made impossible. To solve this problem, an image forming apparatus has been proposed in which intervals (cycles) at which the mark sensor 1103 has actually detected the first HP mark 1101 and the second HP mark 1102 are measured, and when a detection interval is not normal, a notification of the abnormality is issued so as to stop image forming operation (see Japanese Laid-Open Patent Publication (Kokai) H09-054504). Further, in addition to the apparatuses that perform image formation timing control in the above-described manner, there has also been proposed an apparatus that forms, when one of a first HP mark and a second HP mark is determined to be abnormal, an image without using the one HP mark which is determined to be abnormal but using only the other HP mark which is determined to be normal (see Japanese Laid-Open Patent Publication (Kokai) 2000-66562).

In the above described abnormality-detecting method, however, when an abnormality is detected, it is required to stop the operation of the image forming apparatus and carry out maintenance operation, such as HP mark cleaning or replacement of the intermediate transfer member, and hence image forming operation cannot be carried out until completion of the maintenance operation, which leads to considerable reduction of productivity of the image forming apparatus.

Further, when one of the HP marks becomes abnormal, one page of an image is formed based on detection of the normal HP mark, but the other page of an image is not formed, causing degradation in productivity. Moreover, when the two marks become abnormal, the image forming apparatus is stopped so that image formation output cannot be obtained. This is inconvenient to users when they are in haste to obtain image formation output, e.g. when it is required to output a small number of copies urgently. On the other hand, one of factors causing reduction of productivity is that it takes a longer time period to detect a first HP mark depending on the position where the intermediate transfer member has been stopped.

More specifically, according to the method of determining image formation start timing based on HP mark detection, a time period taken before the start of the present sequence of image forming processes (electrostatic latent image forming operation) varies with the distance (positional deviation) between the sensor and an HP mark positioned when the intermediate transfer belt is stopped upon termination of the immediately preceding sequence of image forming processes. As shown in FIG. 23A, for example, when the intermediate transfer belt has been stopped in a position where the HP mark is to be detected by the sensor immediately after stabilization of rotation of an intermediate transfer belt-driving motor, a time period Ta between the start of motor rotation and the detection of the HP mark is short, so that it is possible to quickly start electrostatic latent image forming operation. On the other hand, as shown in FIG. 23B, when the intermediate transfer belt has been stopped in a position where the HP mark is remote from the sensor, it takes a longer time period Tb before electrostatic latent image forming operation is started. This consequence is inconvenient when users are in haste to obtain image formation output, e.g. when it is required to print a small number of copies urgently.

In other words, in order to reduce first copying time, it is desirable to constantly stop the intermediate transfer belt in an optimum position shown e.g. in FIG. 23A after termination of image formation.

However, since tension is applied to the intermediate transfer belt stretched around a plurality of rollers, if the intermediate transfer belt is constantly stopped in the same position, deformations in portions of the belt in contact with the respective rollers, i.e. so-called permanent deformations occur, which can cause degradation of the intermediate transfer belt and considerably lower image quality.

To solve this problem, an image forming apparatus has been proposed, for example, in which a plurality of timers for counting a time period from detection of an HP mark to stoppage of an intermediate transfer belt are arranged so as to prevent the intermediate transfer belt from stopping in the same position (see Japanese Laid-Open Patent Publication (Kokai) No. 2001-201994). In this case, the intermediate transfer belt is not constantly stopped in an optimum position, and hence first copying time in next image forming operation is sometimes increased.

Further, an image forming apparatus is known in which a plurality of HP marks are marked on an intermediate transfer belt so as to prevent the intermediate transfer belt from being constantly stopped in the same position and enable quick HP mark detection (see Japanese Laid-Open Patent Publication (Kokai) No. H06-289684). However, with this arrangement, it is required, in actuality, to mark numerous HP marks on the intermediate transfer belt so as to detect an HP mark in a minimum wait time while preventing permanent deformation of the intermediate transfer belt, which causes an increase in manufacturing costs.

As described above, in an intermediate transfer type image forming apparatus in which colors are superimposed based on HP mark detection, it is difficult to constantly stop an intermediate transfer belt in the same position upon termination of an image forming process, which causes variation in a time period from a time point when the intermediate transfer belt in stoppage is driven to a time point when an HP mark is detected by a sensor for the first time. For this reason, it sometimes takes time before the start of image formation. Further, to solve this problem, it is necessary to arrange timers, for example, which causes an increase in manufacturing costs. Thus, the time period before the first-time HP mark detection occupies a large portion of a time period required for the entire image forming operation, which is generally inefficient for users who very often uses a job for printing a small number of sheets per one image forming operation.

As a countermeasure therefor, an image forming apparatus has been proposed, in which image formation based on detection of an HP mark on an intermediate transfer belt or image formation based on the circumferential length of the intermediate transfer belt is selectively carried out. In the latter image formation, the circumferential length of the intermediate transfer belt is detected in advance based on the HP mark detection, and an image writing reference position signal for starting image formation is issued to thereby carry out the image formation. When an appropriate number of clocks corresponding to the circumferential length have been counted and hence the intermediate transfer belt has completed one rotation, the next image writing reference position signal is issued for the next image formation (see Japanese Laid-Open Patent Publication (Kokai) No. 2004-240306). With this image forming apparatus capable of selecting an appropriate image formation method, the first copying time can be reduced. If, however, the HP mark detection cannot be carried out, it is no longer possible to detect the circumferential length of the intermediate transfer belt, making it impossible to carry out the image formation based on HP mark detection. As a result, the image forming apparatus stops operating, and an image formation output cannot be obtained. This causes inconveniences for users who are in haste to obtain image formation output.

SUMMARY OF THE INVENTION

It is a first object of the present invention to provide an image forming apparatus which is capable of forming an excellent image while suppressing reduction in productivity to a minimum even when an abnormality occurs in detection of an HP mark on an intermediate transfer member, and a control method therefor.

It is a second object of the present invention to provide an image forming apparatus which is capable of forming images efficiently with its inexpensive construction, and a control method therefor.

In a first aspect of the present invention, there is provided an image forming apparatus comprising an image forming portion for forming an image on an image carrier, for primarily transferring the image on the image carrier onto an intermediate transfer member having a plurality of marks indicative of reference positions, to thereby form a color image, and for secondarily transferring the image on the intermediate transfer member onto a recording material to thereby carry out image formation, a detecting portion for detecting the marks on the intermediate transfer member, a controller for causing an image write reference signal, which is to be used to start image formation, to be generated based on an output from the detecting portion, and a determining portion for determining whether or not detection of the marks by the detecting portion is normal, wherein the controller causes the image write reference signal to be generated based on detection of ones of the marks which are determined to be normal by the determining portion, and causes an alternate signal, serving as the image write reference signal, to be generated in association with any of the marks which are determined to be abnormal.

In a second aspect of the present invention, there is provided a method of controlling an image forming apparatus including an image forming portion for forming an image on an image carrier, for primarily transferring the image on the image carrier onto an intermediate transfer member having a plurality of marks indicative of reference positions, to thereby form a color image, and for secondarily transferring the image on the intermediate transfer member onto a recording material to thereby carry out image formation, comprising a detecting step of detecting the marks on the intermediate transfer member, a control step of causing an image write reference signal, which is to be used to start image formation, to be generated based on an output obtained in the detecting step, and a determining step of determining whether or not detection of the marks in the detecting step is normal, wherein the control step causes the image write reference signal to be generated based on detection of ones of the marks which are determined to be normal in the determining step, and causes an alternate signal, serving as the image write reference signal, to be generated in association with any of the marks which are determined to be abnormal.

With the arrangement of the first and second aspects of the present invention, an alternate signal is generated based on a detection signal associated with a mark whose detected state is determined to be normal, in place of a detection signal associated with a mark whose detected state is determined to be abnormal, and the alternate signal is used as an image write reference signal. Therefore, even if an abnormality occurs in detection of a mark on the intermediate transfer member, it is not necessarily required to stop an image forming process, which makes it possible to form an excellent image while suppressing reduction in productivity to a minimum. Further, it is possible to properly perform image formation not only based on the signal indicative of normal mark detection but also based on the alternate signal taking the place of a signal indicative of abnormal mark detection.

Preferably, the controller causes the alternate signal to be generated based on detection of ones of the marks which are determined to be normal.

More preferably, the marks are provided at positions spaced apart by a distance corresponding to half an entire circumference of the intermediate transfer member, and in a case where the recording material has a longitudinal length less than half the entire circumference of the intermediate transfer member, the controller causes, in association with detection of ones of the marks which are determined to be abnormal by the determining portion, the alternate signal to be generated based on detection of ones of the marks which are determined to be normal and a time period corresponding to half the entire circumference of the intermediate transfer member.

Preferably, the controller permits generation of the alternate signal in response to selection of a specific mode, and causes the specific mode to be displayed.

Preferably, when the determining portion determines that detection of any of the marks is abnormal, the controller causes information notifying the determination to be displayed.

In a third aspect of the present invention, there is provided an image forming apparatus comprising an image forming portion for forming an image on an image carrier, for primarily transferring the image on the image carrier onto an intermediate transfer member having at least one mark indicative of a reference position, to thereby form a color image, and for secondarily transferring the image on the intermediate transfer member onto a recording material to thereby carry out image formation, a detecting portion for detecting the mark on the intermediate transfer member, a timer for measuring a time period corresponding to a cycle of the mark on the intermediate transfer member, a first reference signal generator for generating an image write reference signal to be used to start image formation, based on an output from the detecting portion, a second reference signal generator for generating an image write reference signal to be used to start image formation, based on an output from the timer, a determining portion for determining whether or not detection of the mark by the detecting portion is normal, and a selecting section for selecting the second reference signal generator in response to a determination by the determining portion that there is an abnormality.

In a fourth aspect of the present invention, there is provided a method of controlling an image forming apparatus including an image forming portion for forming an image on an image carrier, for primarily transferring the image on the image carrier onto an intermediate transfer member having at least one mark indicative of a reference position, to thereby form a color image, and for secondarily transferring the image on the intermediate transfer member onto a recording material to thereby carry out image formation, comprising a detecting step of detecting the mark on the intermediate transfer member, a time measurement step of measuring a time period corresponding to a cycle of the mark on the intermediate transfer member, a first reference signal generation step of generating an image write reference signal to be to be used to start image formation, based on an output from the detecting step, a second reference signal generation step of generating an image write reference signal to be used to start image formation, based on an output from the time measurement step, a determining step of determining whether or not detection of the mark in the detecting step is normal, and a selection step of selecting the second reference signal generation step in response to a determination in the determining step that there is an abnormality.

With the arrangement of the third and fourth aspects of the present invention, when marks become incapable of being detected, a shift to generation of image write reference signal based the output from the timer is automatically performed, whereby the image write reference signal can be properly generated even when color images are formed and the image formation can be continued.

The above and other objects, features, and advantages of the invention will become more apparent from the following detailed description taken in conjunction with the accompanying drawings.

DESCRIPTION OF THE EMBODIMENTS

The present invention will now be described in detail below with reference to the drawings showing preferred embodiments thereof.

Figure 1:
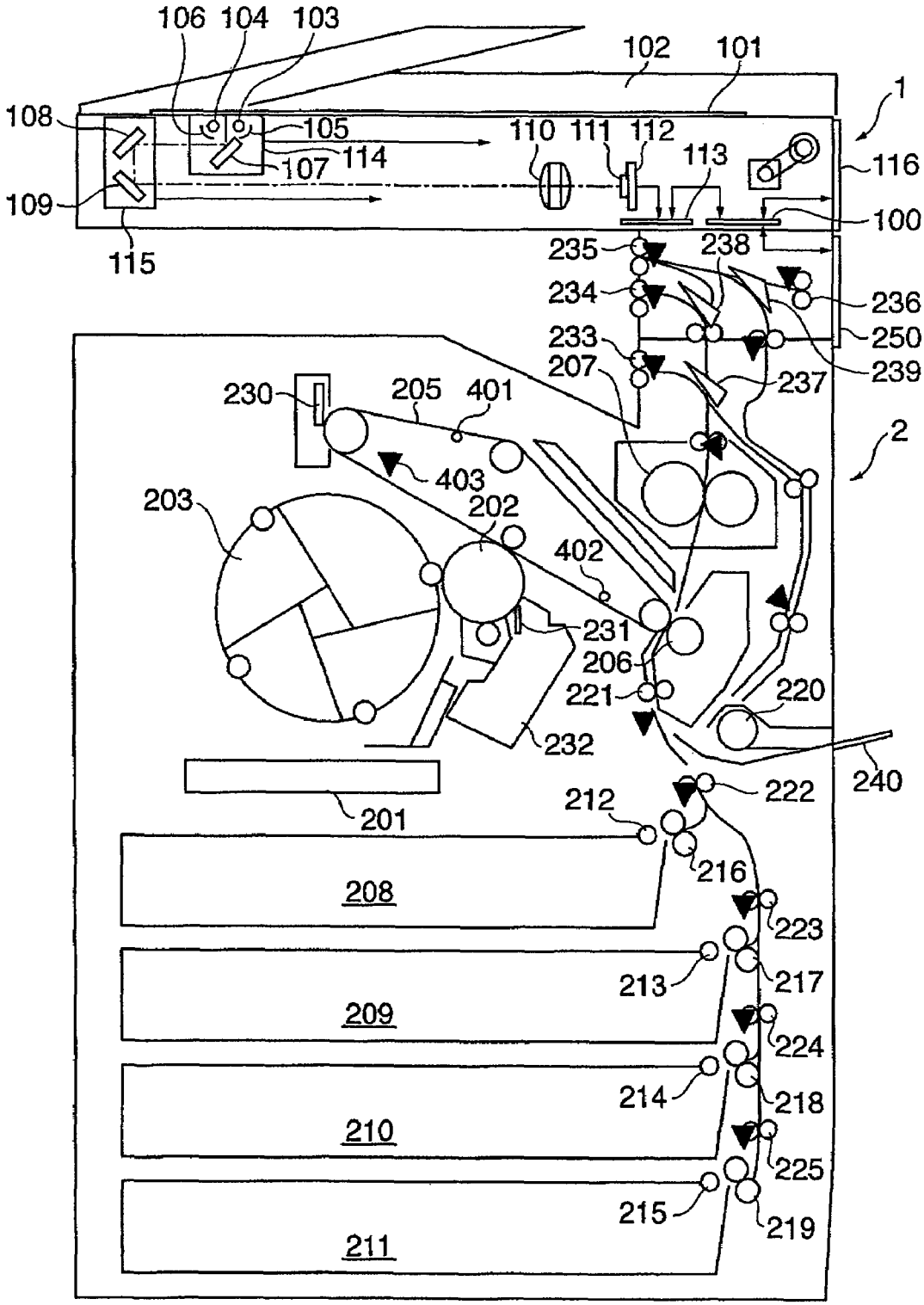
FIG. 1 is a schematic cross-sectional view of an image forming apparatus according to a first embodiment of the present invention.
Figure 2:
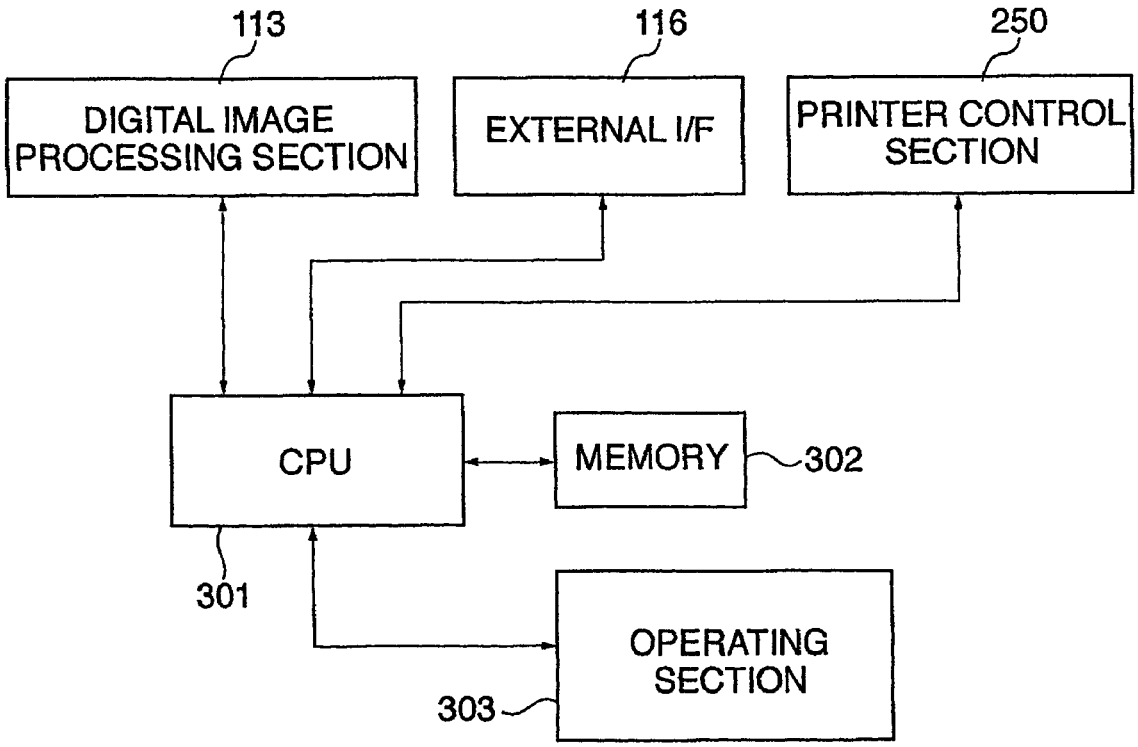
FIG. 2 is a schematic block diagram of a general control section of the image forming apparatus in FIG. 1.

FIG. 1 is a schematic cross-sectional view of an image forming apparatus according to a first embodiment of the present invention. This image forming apparatus functions as a full-color image forming apparatus, and is comprised of a color reader section 1 and a color printer section 2.

First, a description will be given of the color reader section 1. On an original platen glass 101 of the color reader section 1, there is mounted an automatic original feeder (ADF) 102 that automatically feeds originals onto the original platen glass 101. It should be noted that the image forming apparatus may be provided with a mirror pressure plate, not shown, or a white pressure plate, not shown, in place of the automatic original feeder 102. A carriage 114 accommodates light sources 103 and 104, reflectors 105 and 106, and a mirror 107. The light sources 103 and 104 are implemented by halogen lamps, fluorescent lamps, xenon lamps, or the like, and illuminate an original on the original platen glass 101.

Light from the light sources 103 and 104 is converged onto the original by the reflectors 105 and 106, and reflected light (image light) from the original is converged onto a CCD (charge coupled device) image sensor (hereinafter referred to as the CCD) 111 via the mirror 107 within the carriage 114 and mirrors 108 and 109 and a lens 110 within a carriage 115. The carriages 114 and 115 mechanically move in a sub scanning direction Y orthogonal to an electrical scanning direction (main scanning direction X) of the CCD 111 at respective velocities of V and V/2, to thereby scan the entire surface of the original.

The CCD 111 is formed as a color image pickup element, and R, G, and B color filters are mounted on one CCD line in an inline form in the order of R, G, and B. It should be noted that color image pickup function can also be realized by using three R, G, and B light sources or a diachronic prism for color separation in place of the color filters. The CCD 111 is mounted on a substrate 112 having a CCD drive circuit. An image signal picked up by the CCD 111 is subjected to predetermined image processing in a digital image processing section 113, and then output to a printer control section 250 via a general control section 100.

The general control section 100, which controls the overall operation of the present image forming apparatus, includes a CPU 301 and a memory 302. The CPU 301 is connected not only to the memory 302, but also to the digital image processing section 113, the printer control section 250, an external I/F 116, and an operating section 303. The memory 302 stores program codes for controlling the digital image processing section 113, the printer control section 250, and so forth. Further, in the memory 302, there is also formed a work area used by the CPU 301 for execution of the program codes. The power supply of the memory 302 is backed up by a secondary battery, and a function limitation ON flag, described hereinafter, and the like are set in the memory 302.

The operating section 303 is formed by a liquid crystal touch panel, and is configured such that each process can be designated simply by touching an icon representative of an associated process, and the progress of a process currently designated, warning information, and so forth can be displayed. The external I/F 116 provides interface with external devices. More specifically, the external I/F section 116 can be connected to a facsimile machine, not shown, a LAN I/F device, not shown, etc. Transmission and reception of image information and code information to and from the facsimile machine and the LAN I/F device are controlled by mutual communication between the control section (not shown) of each of the facsimile machine and the LAN I/F device and the CPU 301.

Next, image processing executed by the digital image processing section 113 will be described in detail with reference to a functional block diagram in FIG. 3. The present image processing is executed by the digital image processing section 113 under the control of the general control section 100.

Figure 3:
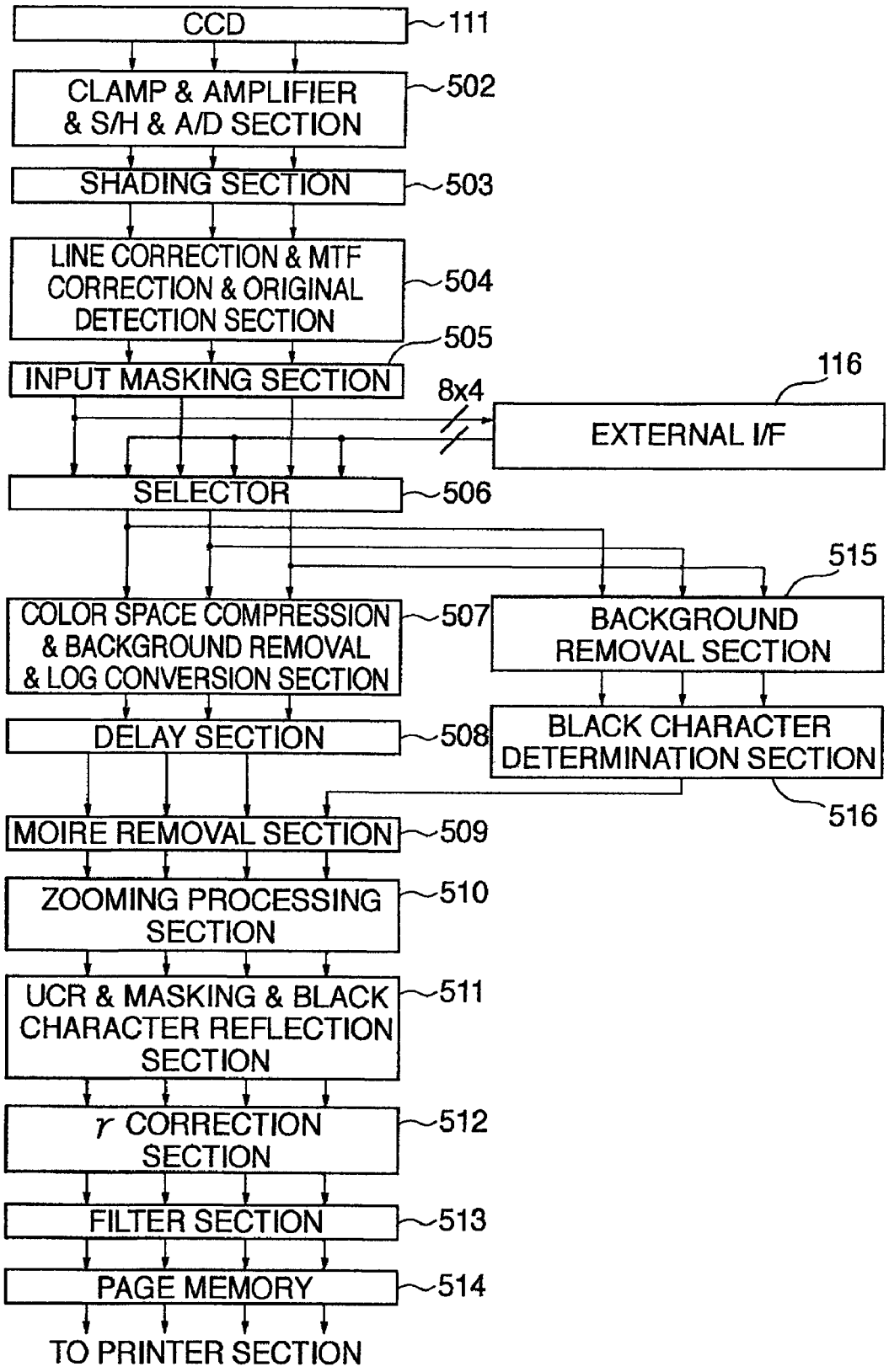
FIG. 3 is a functional block diagram showing functions associated with image processing which is executed by the image forming apparatus in FIG. 1.

As shown in FIG. 3, image signals from the CCD 111, i.e. analog color image signals are input to a clamp & amplifier & S/H & A/D section 502 of the digital image processing section 113 to be sample-held (S/H). Then, the image signal is clamped using the dark level of each analog image signal as a reference potential, and amplified to a predetermined level (the processing order is not limited to that represented by the section name of the clamp & amplifier & S/H & A/D section 502). Further, the image signal is A/D converted into R, G, and B digital signals each consisting e.g. of eight bits and is output to a shading section 503. The R, G, and B signals are subjected to shading correction and black correction by the shading section 503, and then output to a line correction & MTF correction & original detection section 504. If the CCD 111 is a 3-line CCD, read positions on the respective lines differ from each other, and therefore, the line correction & MTF correction & original detection section 504 adjusts delay amounts of the respective lines in accordance with the read speed and corrects signal timing so as to make the read positions on the three lines coincide with each other. Further, MTF in read operation changes depending on the read speed and magnification, and therefore, MTF correction is performed to correct such a change, and then original detection is performed to recognize the size of an original.

An input masking section 505 further corrects the digital signals having undergone the line correction and so forth, according to the spectral characteristics of the CCD 111 and the spectral characteristics of the light sources 103 and 104 and the reflectors 105 and 106. Output signals from the input masking section 505 are input to a selector 506 which can switch between the output signals and signals from the external I/F section 116. Signals output from the selector 506 are input to a color space compression & background removal & LOG conversion section 507 and a background removal section 515.

The background removal section 515 performs background removal on each of the image signals input from the selector 506, and then outputs the signal to a black character determination section 516. The black character determination section 516 determines, based on the image signal having undergone the background removal, whether or not the image signal corresponds to a black character on the original, and generates a black character signal. The generated black character signal is output to a moire removal section 509. The color space compression & Background removal & LOG conversion section 507 determines whether each image signal input from the selector 506 falls within a range of color space reproducible by the printer. If the image signal falls within the range, no correction is performed, whereas if the signal falls outside the range, the image signal is corrected such that it falls within the range reproducible by the printer (color space compression). Then, the color space compression & background removal & LOG conversion section 507 executes background removal processing, converts the R, G, and B signals into C, M, and Y signals (LOG conversion), and outputs the image signals having undergone color space compression & background removal & LOG conversion to a delay section 508.

The delay section 508 delays the image signals output from the color space compression & background removal & LOG conversion section 507 so as to make the timings of the signals match the timings of the black character signals generated by the black character determination section 516, and outputs the delayed image signals to the moire removal section 509. The moire removal section 509 removes moire components from the signals output from the delay section 508 and the black character determination section 516, and a zooming processing section 510 subjects the signals to zooming processing in the main scanning direction.

A UCR & masking & black character reflection section 511 generates Y, M, C, and K signals from the Y, M, and C signals having undergone the moire removal and the zooming processing (UCR processing), and corrects them into signals suited to output operation of the printer (masking processing), and causes the black character signals generated by the black character determination section 516 to be reflected in the Y, X, C, and K signals. The signals processed by the UCR & masking & black character reflection section 511 are subjected to density adjustment by a y correction section 512, and are subjected to smoothing or edge processing by a filter section 513.

The image signals obtained through the above various processes are temporarily stored in a page memory 514 formed on the memory 302 of the general control section 100, and then sequentially delivered as image data signals to the printer control section 250 in timing synchronous with a video clock signal according to color-by-color image write reference timing signals output from the printer control section 250.

Next, a description will be given of the color printer section 2. Referring again to FIG. 1, the printer control section 250 receives control signals from the CPU 301 on the general control section 100 controlling the overall operation of the image forming apparatus, and controls the printing operation of the color printer section 2 according to the control signals sent from the general control section 100 to give instructions for starting of printing, and so forth.

A laser scanner 201 irradiates a photosensitive drum 202 with a laser beam corresponding to an image data signal while scanning the laser beam by a polygon mirror, not shown, in the main scanning direction, to thereby form an electrostatic latent image on the photosensitive drum 202. Clockwise rotation of the photosensitive drum 202 causes the electrostatic latent image formed on the surface of the photosensitive drum 202 to face a corresponding one, which is brought to a sleeve position, of the developing devices of four colors (yellow, magenta, cyan, and black) constituting a rotary color developing device 203. In this sleeve position, toner is transferred from the developing device of a color associated with the sleeve position onto the surface of the photosensitive drum 202, in an amount corresponding to a potential difference created between the surface of the photosensitive drum 202 and a developing sleeve surface to which a developing bias is applied, whereby the electrostatic latent image on the surface of the photosensitive drum 202 is developed as a toner image. The toner image thus formed on the photosensitive drum 202 is primarily transferred onto the intermediate transfer member 205 being rotated counterclockwise by the photosensitive drum 202 rotating clockwise.

In formation of a black monochrome image, toner images are primarily transferred onto the intermediate transfer member 205 at predetermined time intervals. On the other hand, in formation of a full color image, electrostatic latent images on the photosensitive drum 202 corresponding to the respective four colors are sequentially developed using toners of the respective colors by bringing respective corresponding developing devices into the developing sleeve position, and sequentially primarily transferred onto the intermediate transfer member 205. In this case, when the intermediate transfer member 205 performs four rotations, the toner images of the respective four colors are primarily transferred onto the intermediate transfer member 205 in superimposed relation, whereby the primary transfer of a whole color image is completed.

On the other hand, a recording sheet is picked up from one of cassettes, i.e. an upper cassette 208, a lower cassette 209, a third cassette 210, and a fourth cassette 211, by an associated one of pickup rollers 212, 213, 214, and 215, to be fed by an associated one of feed roller pairs 216, 217, 218, and 219, and then are conveyed to a registration roller pair 221 by an associated one of vertical path conveying roller pairs 222, 223, 224, and 225. In a manual sheet feed mode, a recording sheet placed on a manual tray 240 is conveyed by a manual feed roller 220 to the registration roller pair 221.

Then, the recording sheet is conveyed between the intermediate transfer member 205 and a secondary transfer roller 206 by the registration roller pair 221 in timing in which primary transfer of the toner image onto the intermediate transfer member 205 is completed, whereby the full-color toner image on the intermediate transfer member 205 is secondarily transferred onto the recording sheet. Thereafter, the recording sheet is conveyed toward a fixing device in a state sandwiched between the secondary transfer roller 206 and the intermediate transfer member 205, and the toner image is fixed on the recording sheet by being heated and pressed by a fixing roller and a pressure roller 207 forming the fixing device.

Residual toner remaining on the intermediate transfer member 205 is scraped off the surface of the intermediate transfer member 205 by a cleaning blade 230 in post processing executed in the second half of an image forming sequence. On the other hand, residual toner remaining on the photosensitive drum 202 is scraped off the surface of the photosensitive drum 202 by a blade 231, and is disposed of in a waste toner box 232. Although positively and negatively polarized toners sometimes remain on the surface of the secondary transfer roller 206 as well, the residual toners are absorbed onto the intermediate transfer member 205, by alternately applying a secondary transfer positive bias and a secondary transfer reverse bias to the intermediate transfer member 205, and then scraped off the intermediate transfer member 205 by the cleaning blade 230.

In a first discharge mode, a first discharge flapper 237 is switched to a first discharge direction, so that the recording sheet having undergone fixing processing is discharged via a first discharge roller 233. In a second discharge mode, the first discharge flapper 237 and a second discharge flapper 238 are switched to a second discharge direction, so that the recording sheet is discharged via a second discharge roller 234. Further, in a third discharge mode, the first discharge flapper 237 and the second discharge flapper 238 are switched in a direction toward an inverting roller 235, and the recording sheet is inverted by the inverting roller 235. Then, a third discharge flapper 239 is switched to a third discharge direction, and the inverted recording sheet is discharged via a third discharge roller 236.

In a double-sided discharge mode, the recording sheet is once inverted by the inverting roller 235 as in the third discharge mode. Then, the third discharge flapper 239 is switched in a direction to a double-sided unit. The recording sheet is conveyed to the double-sided unit. When a predetermined time period has elapsed after the recording sheet was detected by a double-sided sensor, operation for conveying the recording sheet is temporarily stopped, and as soon as the image forming apparatus is ready for the following image forming sequence, the printing sheet is fed to a secondary transfer position again, whereafter a toner image is formed on a second side (reverse side) of the printing sheet.

In the present image forming apparatus, two pages of images are formed on the intermediate transfer member 205 at positions spaced apart by a distance corresponding to half the entire circumference of the intermediate transfer belt 205, which will be described in detail below.

Figure 4:
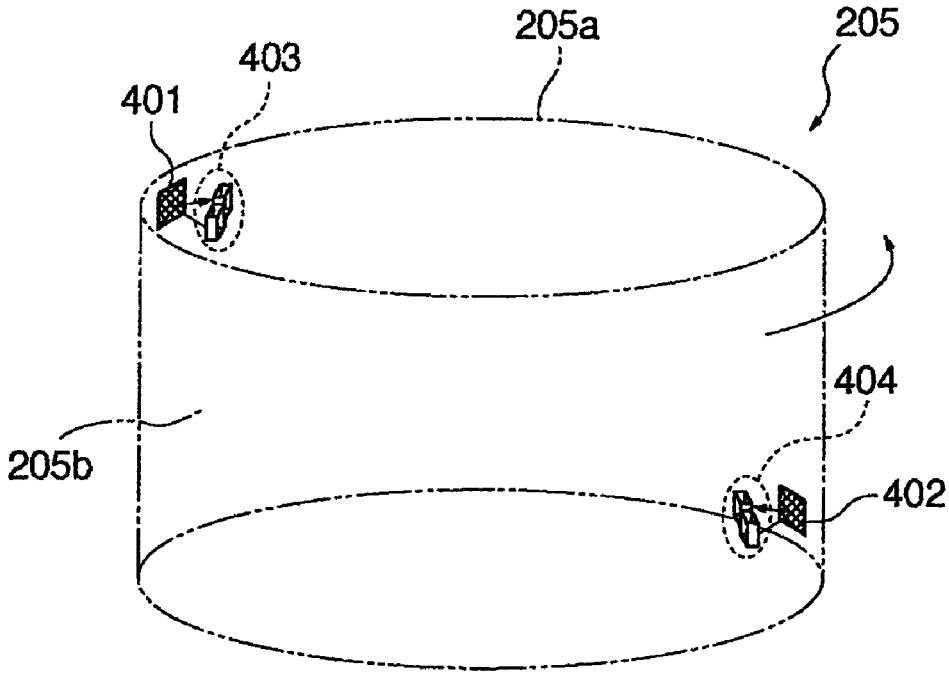
FIG. 4 is a schematic view of an intermediate transfer member according to the first embodiment.

FIG. 4 shows the construction of the intermediate transfer member 205 according to the first embodiment. As shown in FIG. 4, the belt-like intermediate transfer member 205 has an inner peripheral surface thereof marked with a first HP mark 401 and a second HP mark 402 each indicative of a reference position (home position) of the intermediate transfer member 205. The first and second HP marks 401 and 402 are marked in a manner separated from each other by half the circumference. It should be noted that the positions of the respective first and second HP marks 401 and 402 in the main scanning direction are different from each other. Further, inside the intermediate transfer member 205, there are provided a first mark sensor 403 for detecting the first HP mark 401 and a second mark sensor 404 for detecting the second HP mark 402. As the intermediate transfer member 205 is rotated in a direction indicated by an arrow in FIG. 4, the first mark sensor 403 detects the first HP mark 401 once whenever the intermediate transfer member 205 performs one rotation, and the second mark sensor 404 detects the second HP mark 402 once whenever the intermediate transfer member 205 performs one rotation.

As mentioned hereinabove, two pages of images are formed on the intermediate transfer belt 205. More specifically, on the outer peripheral surface of the intermediate transfer member 205, there are formed first and second image transfer areas (corresponding to the first page and the second-page, respectively) 205*a* and 205*b* in association with the respective first and second mark sensors 403 and 404. The first image transfer area 205*a* extends from the first mark sensor 403 to the second mark sensor 404, and the second image transfer area 205*b* extends from the second mark sensor 404 to the first mark sensor 403 such that images developed on the photosensitive drum 202 can be transferred onto the respective image transfer areas 205*a* and 205*b* of the intermediate transfer member 205. For example, in black monochrome image formation, a toner image is primarily transferred onto each of the image transfer areas 205*a* and 205*b* of the intermediate transfer member 205. In full-color image formation, yellow, magenta, cyan, and black toner images are primarily transferred onto each image transfer area in superimposed relation.

Figure 5:
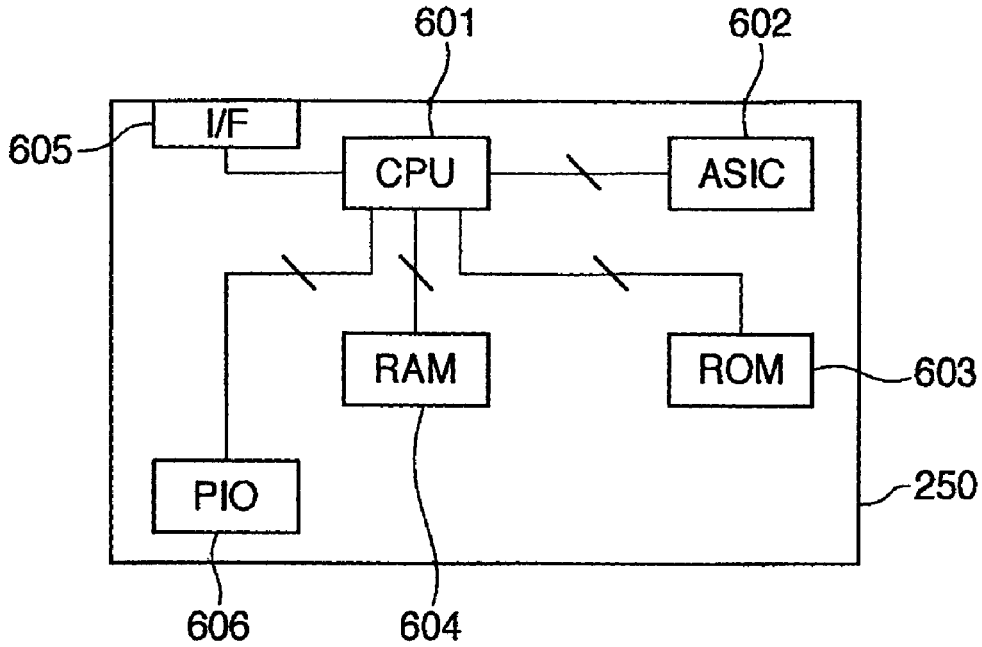
FIG. 5 is a schematic block diagram of a printer control section of the image forming apparatus in FIG. 1.

FIG. 5 is a schematic block diagram of the printer control section 250. The printer control section 250 controls various image forming operations of the printer section 2, with a CPU 601 as a core. The CPU 601 is connected to an ASIC 602, a ROM 603, a RAM 604, a communication I/F 605, and a PIO 606.

The ASIC 602 is provided with a function for realizing a main function of the color printer section 2. The ROM 603 stores control software for the printer control section 250 which is executed by the CPU 601. The CPU 601 uses the RAM 604 as a work area so as to execute the control software stored in the ROM 603. The communication I/F 605 provides communication interface between the printer control section 250 and the general control section 100. The PIO 606 functions as an I/O port via which various control signals are input and output to and from devices in the printer section 2 during execution of image forming operations by the printer section 2.

In the present embodiment, the first HP mark 401 or the second HP mark 402 is detected by the first mark sensor 403 or the second mark sensor 404. The associated HP mark detection signal is input as an interrupt signal to the CPU 601 via the PIO 606. The CPU 601 is provided with ports each of which is supplied with a corresponding one of HP mark detection signals respectively representing detection of the first HP mark 401 and detection of the second HP mark 402. The CPU 601 determines which of the first HP mark 401 and the second HP mark 402 is input on the basis of the port to which an HP mark detection signal has been input. Whenever an HP mark detection signal is input to one of the ports of the CPU 601, the CPU 601 instructs the ASIC 602 to count a detection period associated with the first HP mark 401 or the second HP mark 402.

The ASIC 602 is provided with a function of counting the detection period associated with the first HP mark 401 or the second HP mark 402 based on a predetermined reference clock in response to the instruction for counting the detection period, and storing a value indicative of the counted detection period in a register within the ASIC 602.

Further, in response to an instruction from the CPU 601, the ASIC 602 counts a write start time period T1 (see FIGS. 9 and 10) from a time of detection of the first HP mark 401 to the start of writing of a first-page image or a write start time period T2 (see FIGS. 9 and 10) from a time of detection of the second HP mark 402 to the start of writing of a second-page image, based on a predetermined reference clock. The ASIC 602 outputs an image write reference timing signal to the general control section 100 via the CPU 601 at a time point at which the write start time period T1 or T2 has been counted. The ASIC 602 is capable of driving the laser scanner 201 based on image data signals sequentially input from the general control section 100 in response to the image write reference timing signal in timing synchronous with a video clock.

The CPU 601 instructs the ASIC 602 of permission/inhibition of output of the image write reference timing signal. When instructed to inhibit the output of the image write reference timing signal, the ASIC 602 does not output the signal even if the write start time period T1 or T2 has been counted. The write start time periods T1 and T2 are preset in the ASIC 602 from the CPU 601.

Figure 6:
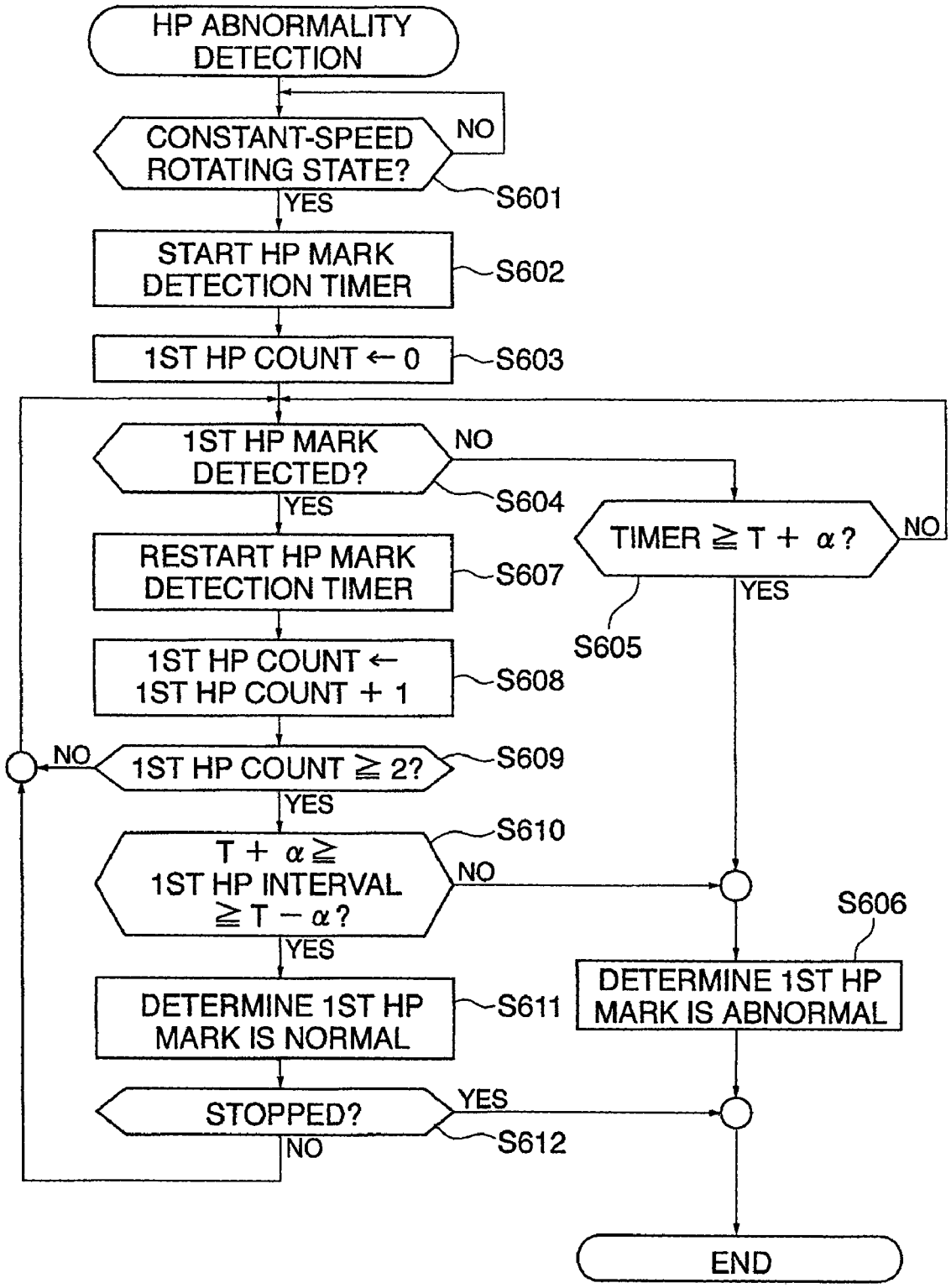
FIG. 6 is a flowchart of an abnormality determining process associated with HP mark detection in the first embodiment.

Next, an abnormality determining process associated with HP mark detection will be described with reference to a flowchart in FIG. 6. The flowchart in FIG. 6, which shows a process for determining an abnormality in detection of the first HP mark 401, can also be applied to a process for determining an abnormality in detection of the second HP mark 402. A determination as to whether the first HP mark 401 has been detected can be carried out based on the port to which the associated HP mark detection signal has been input.

After the power is turned on, in response to a predetermined operator's operation from the operating section 303, the CPU 301 of the general control section 100 instructs the CPU 601 of the printer control section 250 to carry out image formation. The CPU 601 instructs the ASIC 602 to start rotation of the intermediate transfer member 205. Then, when the printer control section 250 enters a constant-speed rotating state (step S601), the CPU 601 starts an HP mark detection timer (step S602) and initializes a detection counter associated with the first HP mark 401 to "0" (step S603).

The CPU 601 determines whether a detection signal associated with the first HP mark 401 has been input from the first mark sensor 403, to thereby determine whether or not the first HP mark 401 was detected (step S604). If it is determined that the first HP mark 401 was not detected, the CPU 601 determines whether or not the count of the HT mark detection timer is not smaller than a time period "T+α" obtained by adding a predetermined margin (α) to a predetermined one-round time period (T) of rotation of the intermediate transfer member 205 (step S605). The predetermined on-round time period (T) of the intermediate transfer belt is stored in the RAM 604.

If the count of the HT mark detection timer is smaller than the time period "T+α", the process returns to the step S604, wherein the CPU 601 awaits detection of the first HP mark 401. On the other hand, if the count of the HT mark detection timer is not smaller than the time period "T+α", i.e. if it is determined that the first HP mark 401 was not detected within the time period "T+α", the CPU 601 sets a flag indicating that the detected state of the first HP mark 401 is abnormal (step 5606), followed by terminating the present abnormality-detecting process.

If it is determined in the step S604 that the first HP mark 401 was detected, i.e. if it is determined that the first HP mark 401 was detected before the lapse of the time period "T+α", the CPU 601 restarts the HT mark detection timer (step S607), and increments the count of the detection counter associated with the first HP mark 401 by "1" (step S608).

Then, the CPU 601 determines whether or not the count of the detection counter has become equal to or larger than "2", i.e. whether or not the first HP mark 401 has been detected more than once (step S609). If the first HP mark 401 has not been detected more than once, the process returns to the step S604, wherein the CPU 601 awaits detection of the first HP mark 401.

On the other hand, if the first HP mark 401 has been detected more than once, the CPU 601 reads out the detection period (detection interval) associated with the first HP mark 401 from the ASIC 602, and determines whether or not the detection period associated with the first HP mark 401 assumes a value within a range of the one-round time period (T) of rotation of the intermediate transfer member 205 with the predetermined margin (α) (step S610). If the detection period associated with the first HP mark 401 does not assume a value within the range of the one-round time period (T) of rotation of the intermediate transfer member 205 with the predetermined margin (α), the CPU 601 sets the flag indicating that the detected state of the first HP mark 401 is abnormal (step S606), followed by terminating the present abnormality-detecting process.

On the other hand, if the detection period associated with the first HP mark 401 assumes a value within the range of the one-round time period (T) of rotation of the intermediate transfer member 205 with the predetermined margin (α), the CPU 601 sets a flag indicating that the detected state of the first HP mark 401 is normal (step S611). The CPU 601 continuously carries out the above processing until rotation of the intermediate transfer member 205 is stopped (step. S612). It should be noted that the abnormality determination of the HP mark detection can be carried out after the intermediate transfer member 205 has entered a constant-speed rotating state after the power is turned on.

Next, a function limitation setting process executed when an abnormality occurs in HP mark detection will be described with reference to FIGS. 7 and 8. The function limitation setting process is implemented by setting the limited-function mode from the operating section. This process provides the function of operating the image forming apparatus at an image forming speed (the number of printed sheets per predetermined time period) which is half the normal image forming speed.

When the power is turned on, the CPU 301 of the general control section 100 determines whether or not the function limitation ON flag has been set in the memory 302 yet (step S701). If the function limitation ON flag has already been set in the memory 302, the CPU 301 carries out a step S707, described hereinafter.

Figure 8A:
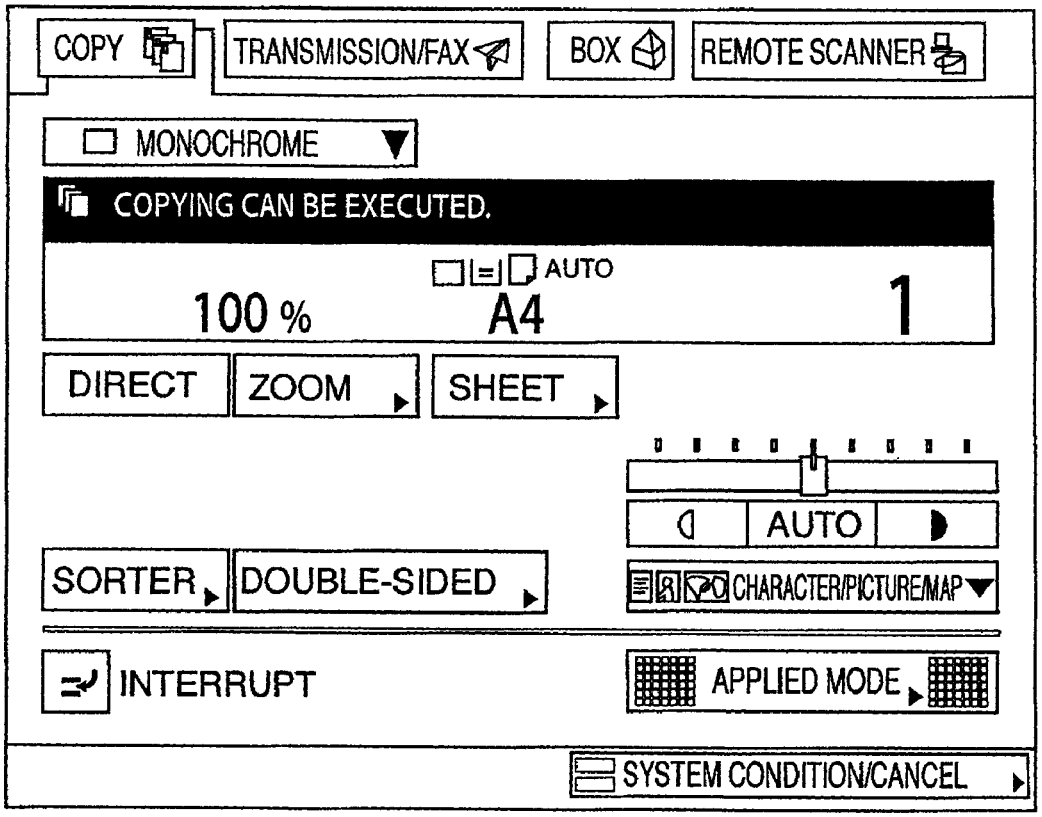
FIG. 8A is a view of a normal operating screen.
Figure 8B:
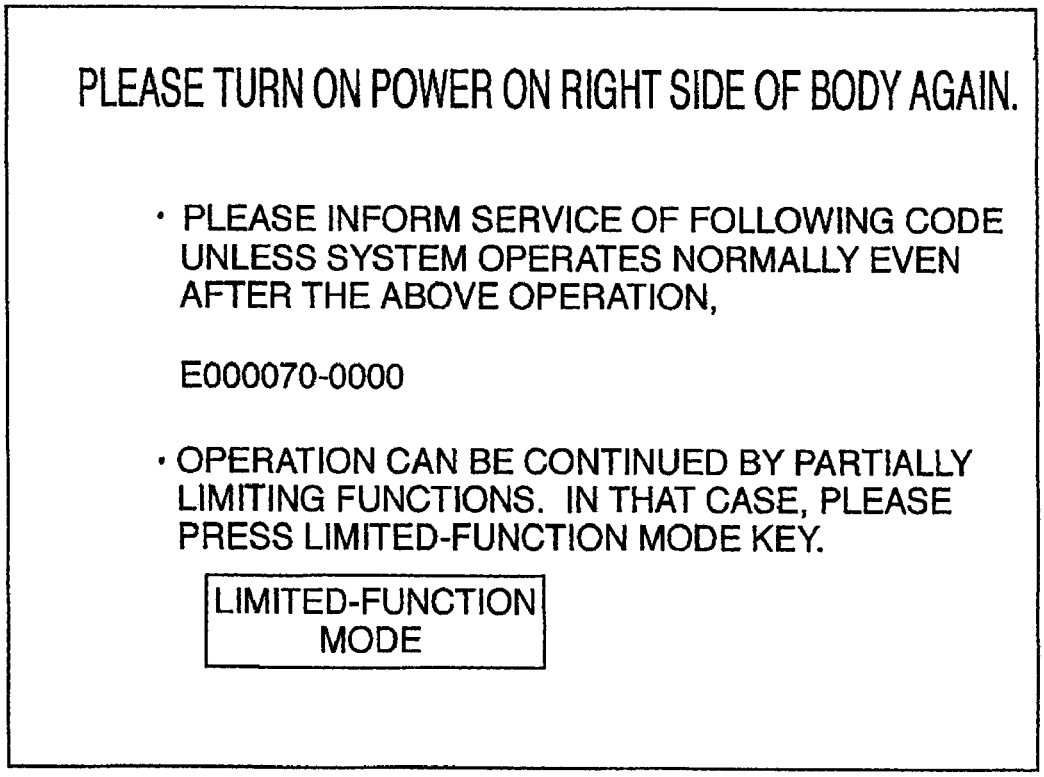
FIG. 8B is a view of a display screen associated with the function limitation setting process.

On the other hand, if the function limitation ON flag has not been set (i.e. when normal), the CPU 301 causes a normal operating screen (user interface screen) to be displayed as shown in FIG. 8A on a display panel of the operating section 303 upon completion of preparation for a predetermined image forming process, and awaits input of an instruction for image formation from a user (step S702). During execution of the image forming process in response to the instruction for image formation issued via the operating screen in FIG. 8A, when the flag indicating that the detected state of the first HP mark 401 or the second HP mark 402 is abnormal is set by the CPU 601 (step S703), the CPU 301 causes operations for image formation and the like to stop and a guidance screen to be displayed as shown in FIG. 8B on the display panel of the operating section 303 (step S704). On this guidance screen, there is displayed a "limited-function mode" key as shown in FIG. 8B. The present image forming apparatus can be operated in a limited-function mode by depressing the "limited-function mode" key. It should be noted that in the limited-function mode, an image forming speed (the number of printed sheets per predetermined time period) is reduced to half of an image forming speed in the normal mode.

Then, the CPU 301 determines whether or not the "limited-function mode" key was pressed (step S705). If it is determined that the "limited-function mode" key was not pressed, the CPU 301 enters a power OFF wait state with the operations kept stopped. In this case, when predetermined maintenance operations including HP mark cleaning are completely performed in a power-off state, and then the power is turned on again, it is determined in the step S703 that the detected state of the first HP mark 401 or the second HP mark 402 is normal, whereby normal image forming operation is allowed.

Figure 8C:
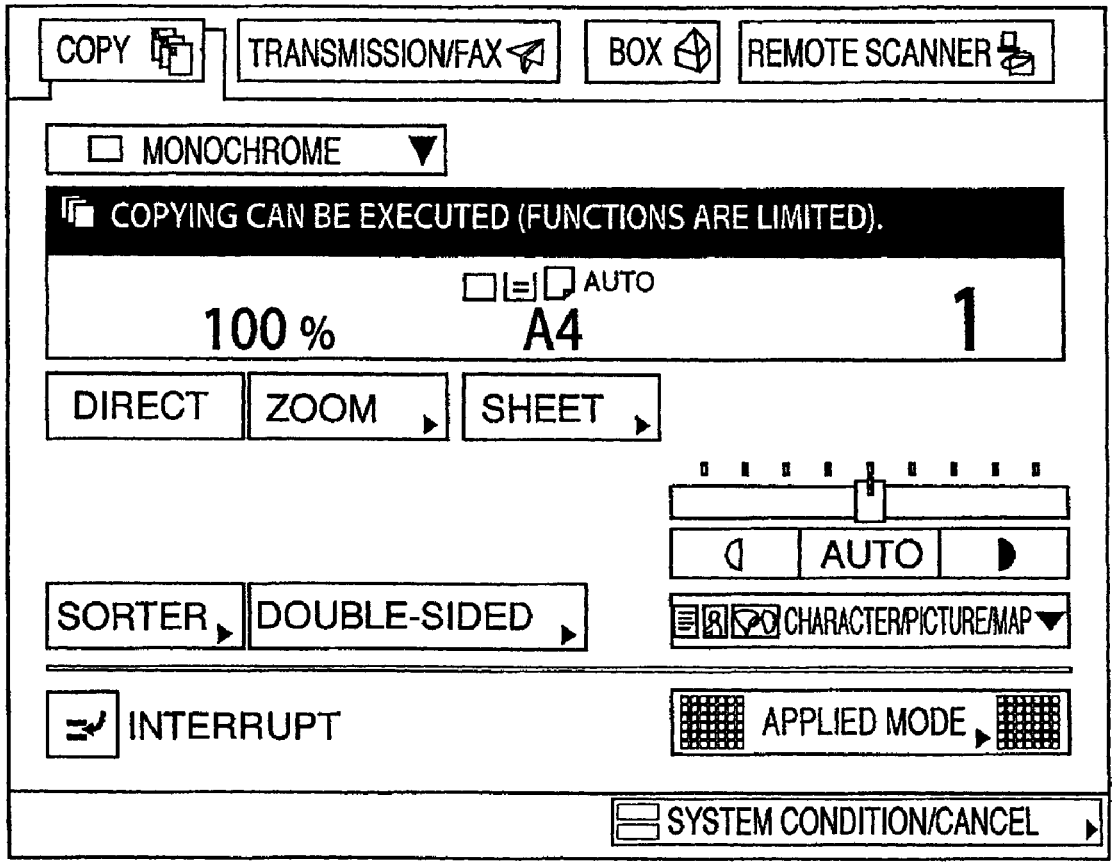
FIG. 8C is a view of the operating screen with an additional message indicating that a limited-function mode has been selected.

On the other hand, if it is determined that the "limited-function mode" key was pressed, the CPU 301 sets the function limitation ON flag in the memory 302 (step S706), and causes an operating screen shown in FIG. 8C to be displayed on the display panel of the operating section 303, by adding to the normal screen in FIG. 8A a message notifying that "function limitation is being executed" i.e. that "the image forming apparatus is in the limited-function mode" (step S707).

When the power is turned off in the "limited-function mode", and then the power is turned on again, it is determined in the step S701 that the function limitation ON flag has already been set in the memory 302, and the process proceeds to the step S707. Therefore, the operating screens in FIGS. 8A and 8B are not displayed. Further, when the predetermined maintenance operations are carried out with the function limitation ON flag set, and the detected state of the first HP mark 401 or the second HP mark 402 is normalized, it is possible to cancel the limited-function mode e.g. by executing predetermined operation in the operating section 303.

Figure 9:
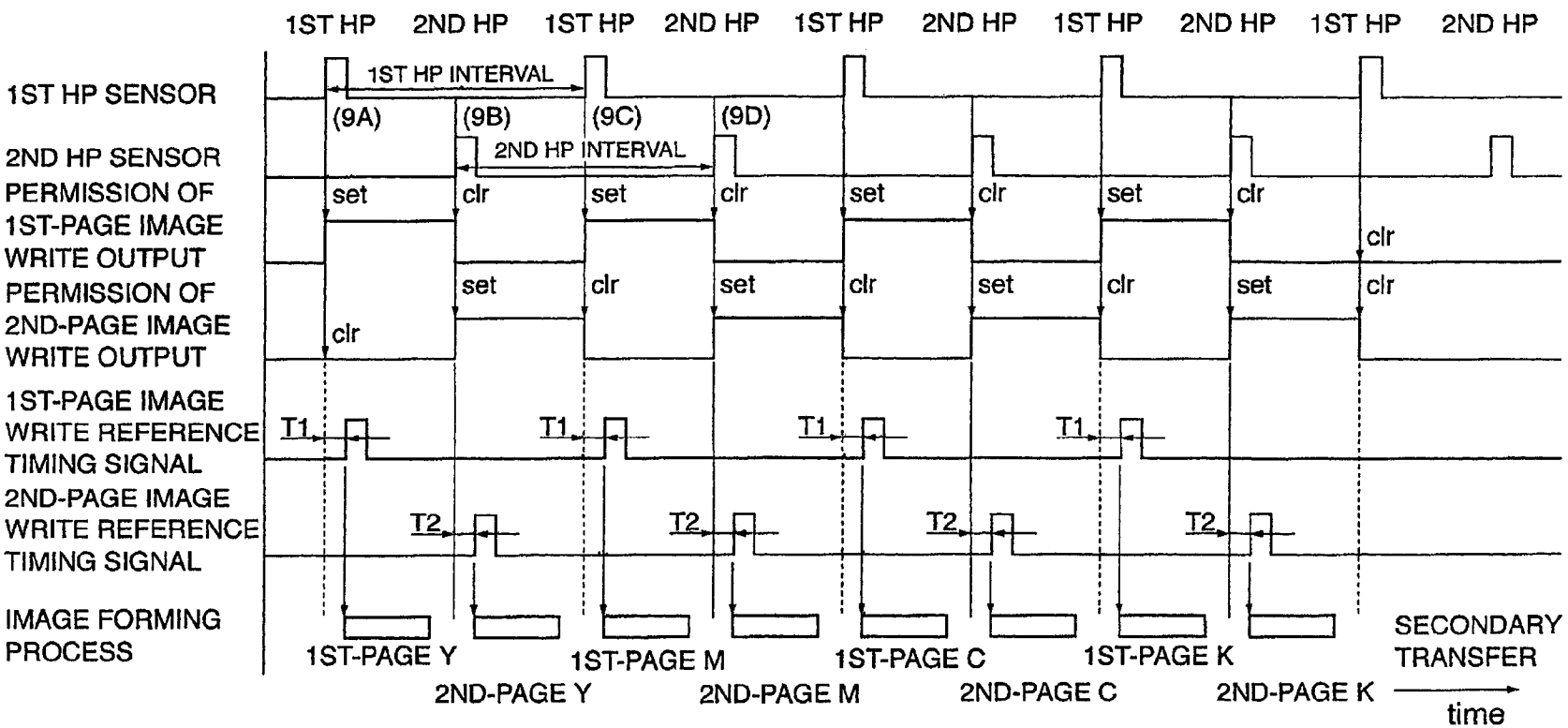
FIG. 9 is a timing diagram useful in explaining processing for forming full-color images corresponding to respective two pages on the intermediate transfer member in a non-limited-function mode in the first embodiment.

Next, processing for forming two pages of full-color images on the intermediate transfer member 205 in a non-limited-function mode (normal mode) will be described with reference to a timing diagram in FIG. 9. It should be noted that FIG. 9 corresponds to the case where the first HP mark 401 is detected earlier than the second HP mark 402 (ditto for FIG. 10, described hereinafter).

When the first HP mark 401 is detected by the first mark sensor 403 (9A), the CPU 601 of the printer control section 250 inhibits the ASIC 602 from outputting a second-page image write reference timing signal and permits the same to output a first-page image write reference timing signal. In this case, when the write start time period T1 before the start of writing of a first-page image has been counted, the ASIC 602 outputs the first-page image write reference timing signal to the general control section 100 via the CPU 601. The write start time period T1 is stored in the RAM 604.

The general control section 100 outputs first-page yellow image data to the printer control section 250 based on the first-page image write reference timing signal. Under the control of the CPU 601, the ASIC 602 of the printer control section 250 drives the laser scanner 201 to form an electrostatic latent image for a first-page yellow image on the photosensitive drum 202 based on the first-page yellow image data, develop the electrostatic latent image by yellow toner, and then primarily transfer the yellow toner image onto the intermediate transfer member 205.

Next, when the second HP mark 402 is detected by the second mark sensor 404 (9B), the CPU 601 of the printer control section 250 inhibits the ASIC 602 from outputting the first-page image write reference timing signal and permits the same to output the second-page image write reference timing signal. In this case, when the write start time period T2 before the start of writing of a second-page image has been counted, the ASIC 602 outputs the second-page image write reference timing signal to the general control section 100 via the CPU 601. The write start time period T2 is stored in the RAM 604.

The general control section 100 outputs second-page yellow image data to the printer control section 250 based on the second-page image write reference timing signal. Under the control of the CPU 601, the ASIC 602 of the printer control section 250 drives the laser scanner 201 to form an electrostatic latent image for a second-page yellow image on the photosensitive drum 202 based on the second-page yellow image data, develop the electrostatic latent image by yellow toner, and then primarily transfer the yellow toner image onto the intermediate transfer member 205.

Next, when the first HP mark 401 is detected by the first mark sensor 403 (9C), the CPU 601 of the printer control section 250 inhibits the ASIC 602 from outputting the second-page image write reference timing signal and permits the same to output the first-page image write reference timing signal. In this case, when the write start time period T1 before the start of writing of a first-page image has been counted, the ASIC 602 outputs the first-page image write reference timing signal to the general control section 100 via the CPU 601, whereby a first-page magenta toner image is primarily transferred onto the intermediate transfer member 205 in a manner superimposed on the first-page yellow toner image.

Next, when the second HP mark 402 is detected by the second mark sensor 404 (9D), the CPU 601 of the printer control section 250 inhibits the ASIC 602 from outputting the first-page image write reference timing signal and permits the same to output the second-page image write reference timing signal. In this case, when the write start time period T2 before the start of writing of a second-page image has been counted, the ASIC 602 similarly outputs the second-page image write reference timing signal to the general control section 100 via the CPU 601, whereby a second-page magenta toner image is primarily transferred onto the intermediate transfer member 205 in a manner superimposed on the second-page yellow toner image.

Similarly, first-page cyan and black toner images and second-page cyan and black toner images are respectively primarily transferred onto the intermediate transfer member 205 in superimposed relation. Then, after completion of the primary transfer of the second-page black toner image, the CPU 601 of the printer control section 250 inhibits the ASIC 602 from outputting the first-page and second-page image write reference timing signals and instructs the same to sequentially secondarily transfer the first-page and second-page full-color images on the intermediate transfer member 205 to respective recording sheets.

As described above, in the non-limited-function mode (normal mode), when the first HP mark 401 is detected earlier than the second HP mark 402, a first-page full-color image is formed in timing synchronous with detection of the first HP mark 401, and a second-page full-color image is formed in timing synchronous with detection of the second HP mark 402. It should be noted that when the second HP mark 402 is detected earlier than the first HP mark 401 in the non-limited-function mode (normal mode), a first-page full-color image is formed with reference to the time of detection of the second HP mark 402, and a second-page full-color image is formed with reference to the time of detection of the first HP mark 401.

Figure 10:
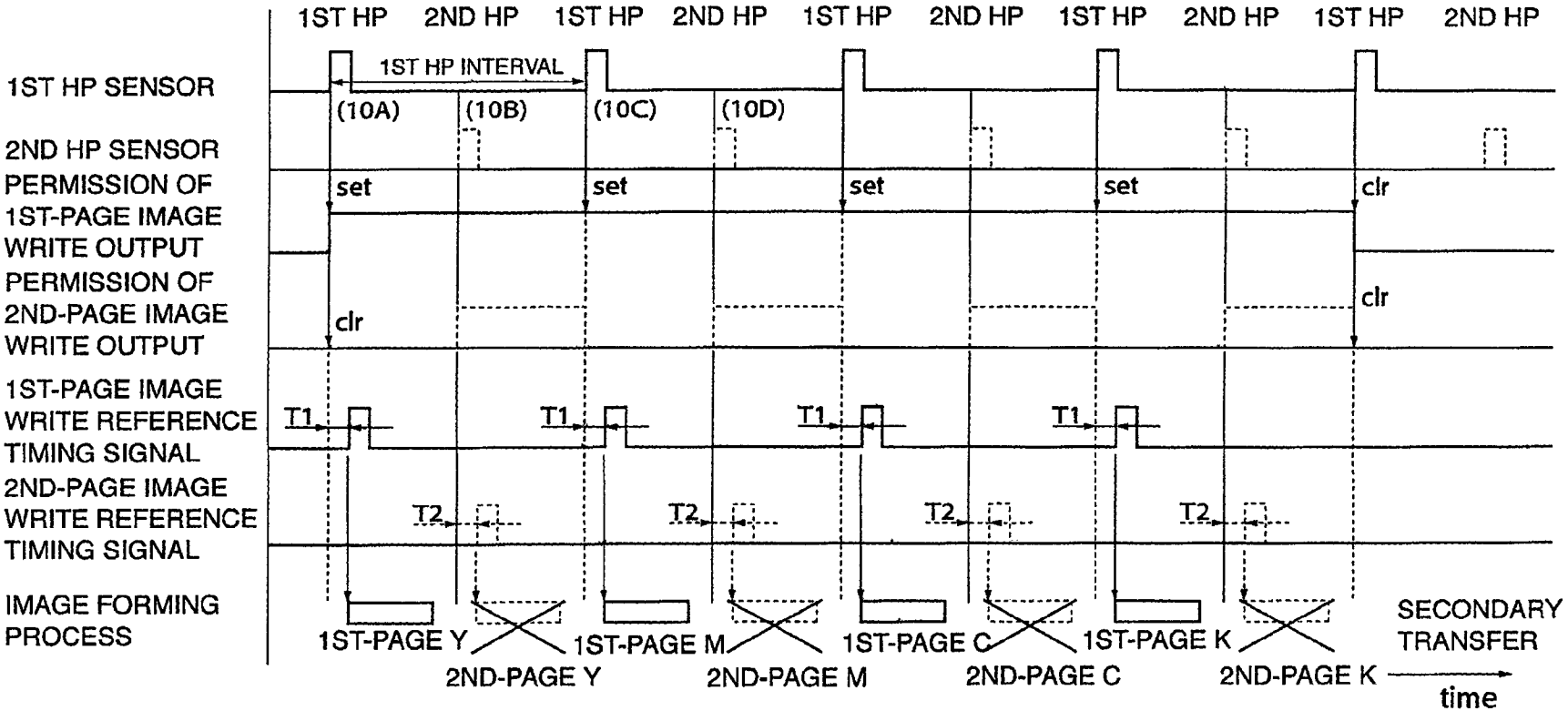
FIG. 10 is a timing diagram useful in explaining processing for forming a full-color image on the intermediate transfer member in the limited-function mode in the first embodiment.

Next, processing for forming a full-color image on the intermediate transfer member 205 in the limited-function mode will be described with reference to a timing diagram in FIG. 10. It should be noted that FIG. 10 corresponds to the case where the detected state of the second HP mark 402 is abnormal.

When the first HP mark 401 is detected by the first mark sensor 403 (10A), the CPU 601 of the printer control section 250 inhibits the ASIC 602 from outputting the second-page image write reference timing signal and permits the same to output the first-page image write reference timing signal. In this case, when the write start time period T1 before the start of writing of a first-page image has been counted, the ASIC 602 outputs the first-page image write reference timing signal to the general control section 100 via the CPU 601.

The general control section 100 outputs first-page yellow image data to the printer control section 250 based on the first-page image write reference timing signal. Under the control of the CPU 601, the ASIC 602 of the printer control section 250 drives the laser scanner 201 to form an electrostatic latent image for a first-page yellow image on the photosensitive drum 202 based on the first-page yellow image data, develop the electrostatic latent image by yellow toner, and then primarily transfer the yellow toner image onto the intermediate transfer member 205.

At this time, since the detected state of the second HP mark 402 is abnormal, the CPU 601 stops operation for reading the detection signal associated with the second HP mark 402 from the second mark sensor 404 (see 10B and 10D), without permitting the ASIC 602 to output the second-page image write reference timing signal based on the detection signal associated with the second HP mark 402 as in the normal mode. In short, the CPU 601 causes second-page image formation to be inhibited.

More specifically, even when the first HP mark 401 is detected by the first mark sensor 403 next time (10C), the CPU 601 of the printer control section 250 keeps on inhibiting the ASIC 602 from outputting the second-page image write reference timing signal and only permits the same to output the first-page image write reference timing signal. Further, the CPU 601 instructs the ASIC 602 to count the write start time period T1 before the start of writing of a first-page image to thereby cause a first-page magenta toner image to be primarily transferred onto the intermediate transfer member 205 in a manner superimposed on the first-page yellow toner.

Similarly, first-page cyan and black toner images are primarily transferred onto the intermediate transfer member 205 in superimposed relation. Then, after completion of the primary transfer of the first-page black toner image, the CPU 601 of the printer control section 250 inhibits the ASIC 602 from outputting the first-page image write reference timing signal and instructs the same to secondarily transfer the first-page full-color image on the intermediate transfer member 205 to a recording sheet.

As described above, according to the first embodiment, in the limited-function mode set when the detected state of an HP mark becomes abnormal, a full-color image is formed on the intermediate transfer member 205 using a detection signal associated with a normally detected HP mark. In this case, since only one image is formed on the intermediate transfer member 205, the productivity of the apparatus is reduced to half the productivity in the normal mode. However, even if the detected state of an HP mark has become abnormal, image formation ensuring high image quality without color displacement or the like can be continued.

Further, when an abnormality occurs in HP mark detection, the user is allowed to optionally select whether or not to continue image formation in the limited-function mode, and what is more, a message notifying that the image forming apparatus is in the limited-function mode is displayed. This improves the user friendliness of the apparatus.

It should be noted that when the detected state of the first HP mark 401 has become abnormal, the detection signal associated with the second HP mark 402 can be used for formation of a full-color image on the intermediate transfer member 205. Further, the first embodiment can also be applied to the case where the intermediate transfer member 205 is marked with three or more HP marks.

In the following, a description will be given of an image forming apparatus according to a second embodiment of the present invention.

The apparatus according to the present embodiment is basically identical to the image forming apparatus according to the first embodiment, and hence only different points will be described.

Figure 11:
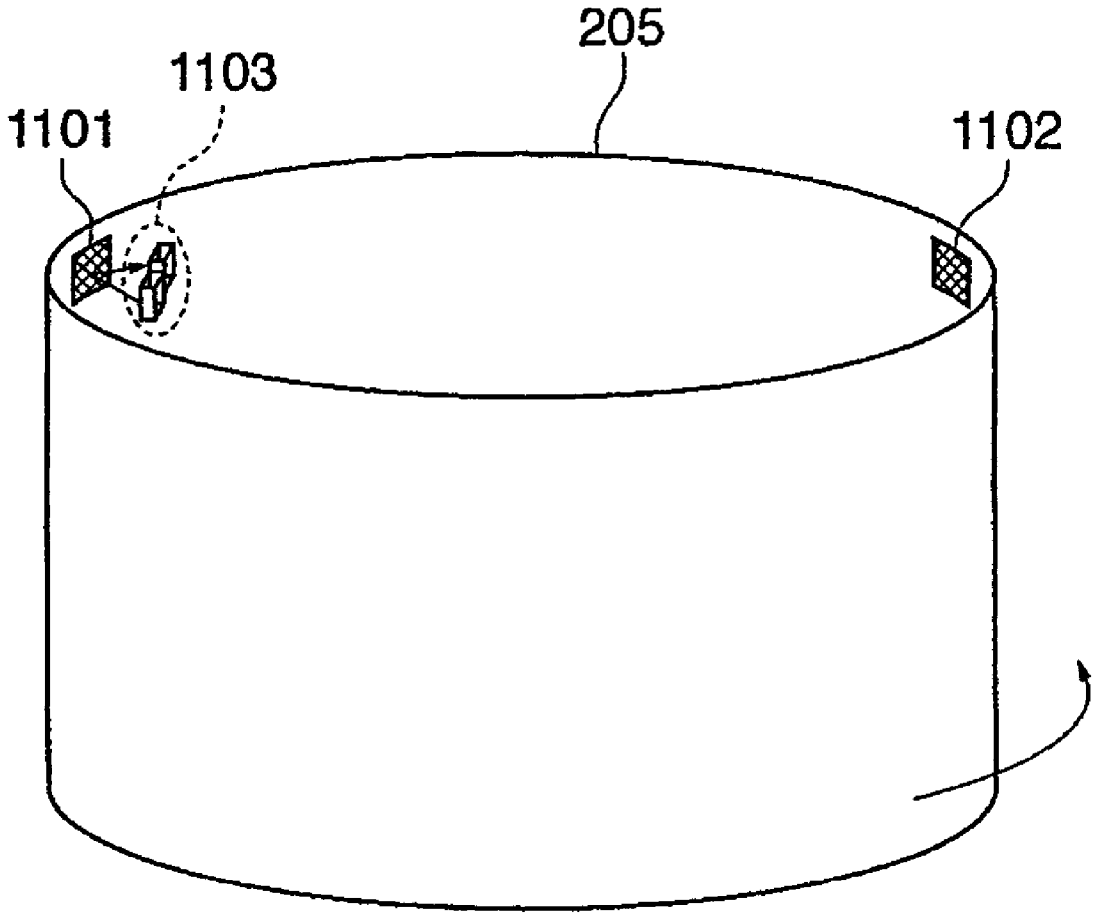
FIG. 11 is a schematic view of an intermediate transfer member according to the second embodiment.

As distinct from the first embodiment in which the mark sensors 403 and 404 dedicated to the respective individual detections of the first and second HP marks 401 and 402 marked in the intermediate transfer member 205 are provided, as shown in FIG. 4, in the second embodiment, only a single mark sensor 1103 common to first and second HP marks 1101 and 1102 is provided in the intermediate transfer member 205 as shown in FIG. 11.

Similarly to the first and second HP marks 401 and 402 in the first embodiment, the first HP mark 1101 and the second HP mark 1102 are marked in the intermediate transfer member 205 in a manner separated from each other by half the circumference of the intermediate transfer member 205. However, the first and second HP marks 1101 and 1102 are disposed at the same location in the main scanning direction so that they can be detected by the single mark sensor 1103.

Figure 12:
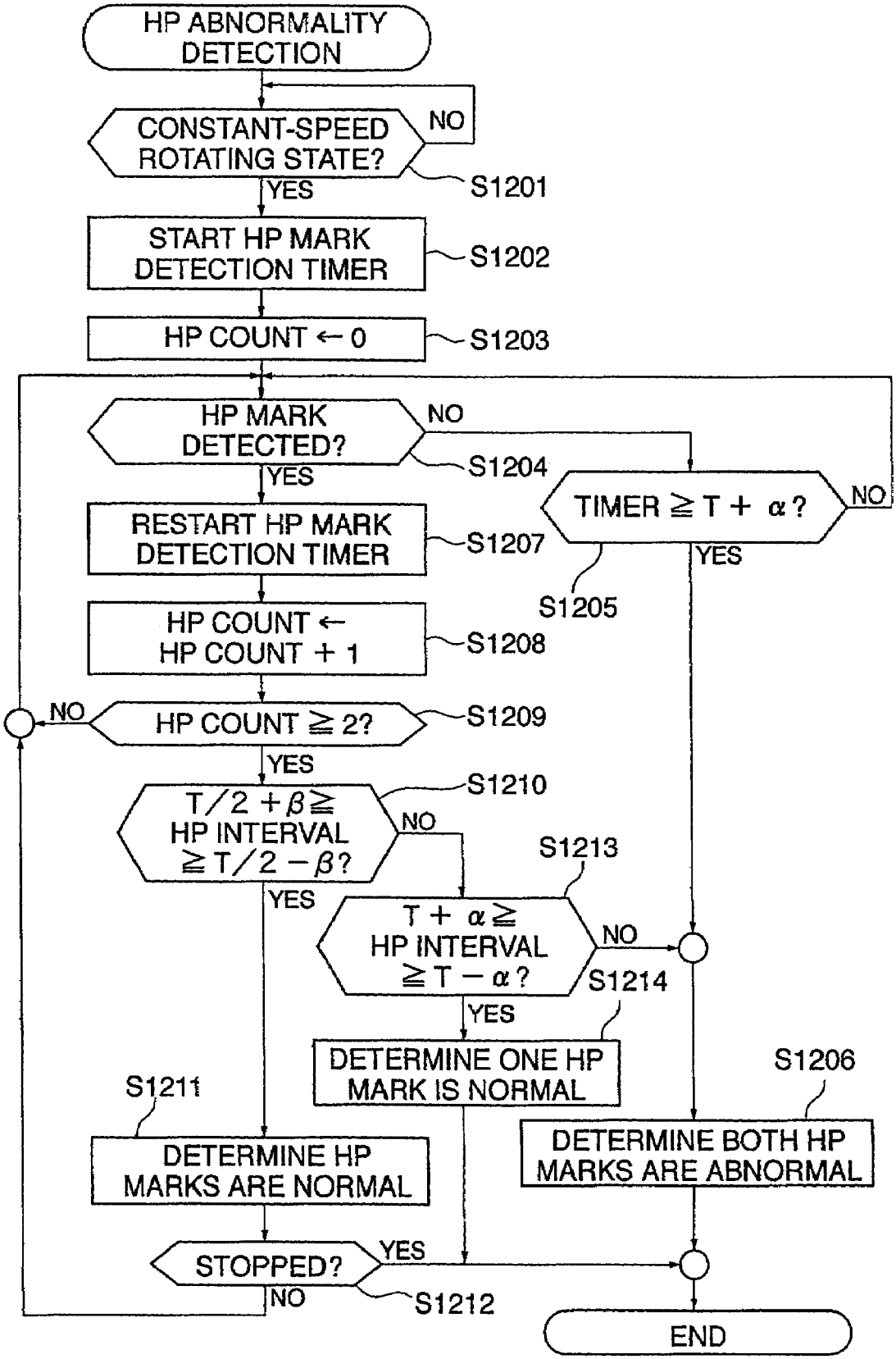
FIG. 12 is a flowchart of an abnormality determining process associated with HP mark detection in the second embodiment.

Next, an abnormality determining process associated with HP mark detection in the second embodiment will be described with reference to a flowchart in FIG. 12.

After the power is turned on, in response to the predetermined operator's operation from the operating section 303, the CPU 301 of the general control section 100 instructs the CPU 601 of the printer control section 250 to carry out image formation. The CPU 601 instructs the ASIC 602 to start rotation of the intermediate transfer member 205. Then, when the intermediate transfer member 205 enters the constant-speed rotating state (step S1201), the CPU 601 starts the HP mark detection timer (step S1202) and initializes the HP mark detection counter to "0" (step S1203).

The CPU 601 determines whether an HP mark detection signal has been input from the mark sensor 1103, to thereby determine whether or not the first HP mark 1101 or the second HP mark 1102 was detected (step S1204). If it is determined that neither the first HP mark 1101 nor the second HP mark 1102 was detected, the CPU 601 determines whether or not the count of the HT mark detection timer is not smaller than the time period "T+α" obtained by adding the predetermined margin (α) to the predetermined one-round time period (T) of rotation of the intermediate transfer member 205 (step S1205).

If it is determined that the count of the HT mark detection timer is smaller than the time period "T+α", the process returns to the step S1204, wherein the CPU 601 awaits detection of the first HP mark 1101 or the second HP mark 1102. On the other hand, if the count of the HT mark detection timer is not smaller than the time period "T+α", i.e. if it is determined that the first HP mark 1101 or the second HP mark 1102 was not detected within the time period "T+α", the CPU 601 sets a flag indicating that the detected states of the respective first and second HP marks 1101 and 1102 are both abnormal (step S1206), followed by terminating the present abnormality-detecting process.

If it is determined in the step S1204 that the first HP mark 1101 or the second HP mark 1102 was detected, i.e. if it is determined that the first HP mark 1101 or the second HP mark 1102 was detected before the lapse of the time period "T+α", the CPU 601 restarts the HT mark detection timer (step S1207), and increments the count of the HP mark detection counter by "1" (step S1208)

Then, the CPU 601 determines whether or not the count of the detection counter has become equal to or larger than "2", i.e. whether or not the total number of times of detection of the first HP mark 1101 and the second HP mark 1102 has become equal to or larger than two (step S1209).

If it is determined that the total number of times of detection of the first HP mark 1101 and the second HP mark 1102 has not exceeded two, the process returns to the step S1204, wherein the CPU 601 awaits detection of the first HP mark 1101 or the second HP mark 1102.

On the other hand, if the total number of times of detection of the first HP mark 1101 and the second HP mark 1102 has become equal to or larger than two, the CPU 601 reads out from the ASIC 602 an HP mark detection period, i.e. a period (detection interval) between detection of the first HP mark 1101 and detection of the second HP mark 1102 or between detection of the second HP mark 1102 and detection of the first HP mark 1101, and determines whether or not the HP mark detection period assumes a value within a range of a half-round time period (T/2) of rotation of the intermediate transfer member 205 with a predetermined margin (β) (step S1210). The predetermined half-round time period (T/2) and the one-round time period (T) of rotation of the intermediate transfer member 205 are stored in the RAM 604.

If it is determined that the HP mark detection period does not assume a value within the range of the half-round time period (T/2) of rotation of the intermediate transfer member 205 with the predetermined margin (β), the CPU 601 further determines whether or not the HP mark detection period assumes a value within the range of the one-round time period (T) of rotation of the intermediate transfer member 205 with the predetermined margin (α) (step S1213).

If it is determined that the HP mark detection period assumes a value within the range of the one-round time period (T) of rotation of the intermediate transfer member 205 with the predetermined margin (α), the CPU 601 sets a flag indicating that the detected state of the first HP mark 1101 or the second HP mark 1102 is abnormal (step S1214), followed by terminating the present abnormality-detecting process. On the other hand, if the HP mark detection period does not assume a value within the range of the one-round time period (T) of rotation of the intermediate transfer member 205 with the predetermined margin (α), the CPU 601 sets the flag indicating that the detected states of the respective first and second HP marks 1101 and 1102 are both abnormal (step S1206), followed by terminating the present abnormality-detecting process.

If it is determined in the step S1210 that the HP mark detection period assumes a value within the range of the half-round time period (T/2) of rotation of the intermediate transfer member 205 with the predetermined margin (β), the CPU 601 sets a flag indicating that the detected states of the respective first and second HP marks 1101 and 1102 are both normal (step S1211). Thereafter, the CPU 601 continuously carries out the above processing until rotation of the intermediate transfer member 205 is stopped (step S1212).

Figure 7:
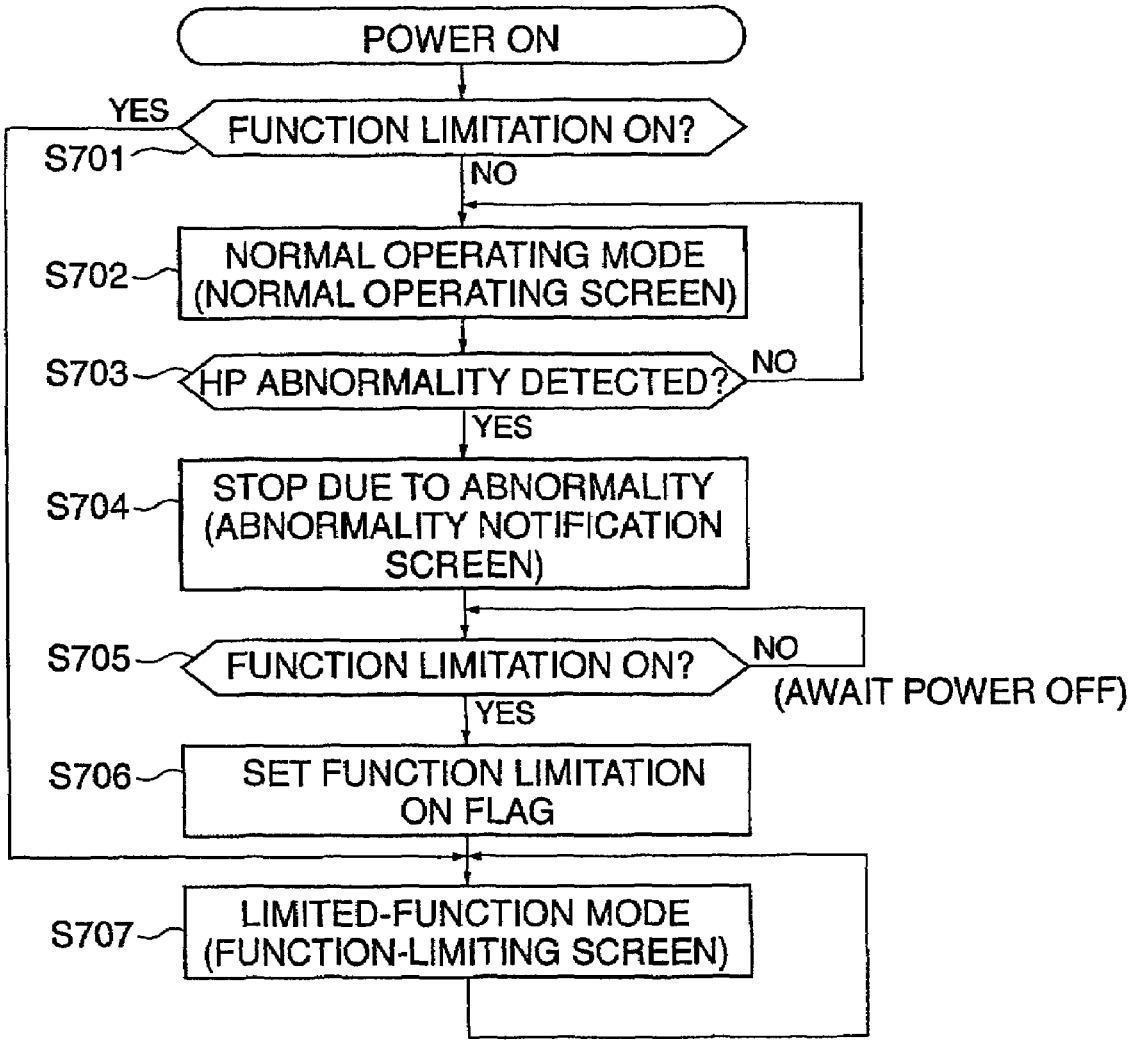
FIG. 7 is a flowchart of a function limitation setting process in the first embodiment of the present invention.

A function limitation setting process executed in the second embodiment when an abnormality occurs in HP mark detection is quite the same as the function limitation setting process in the first embodiment which was described hereinbefore with reference to FIGS. 7 and 8.

Figure 13:
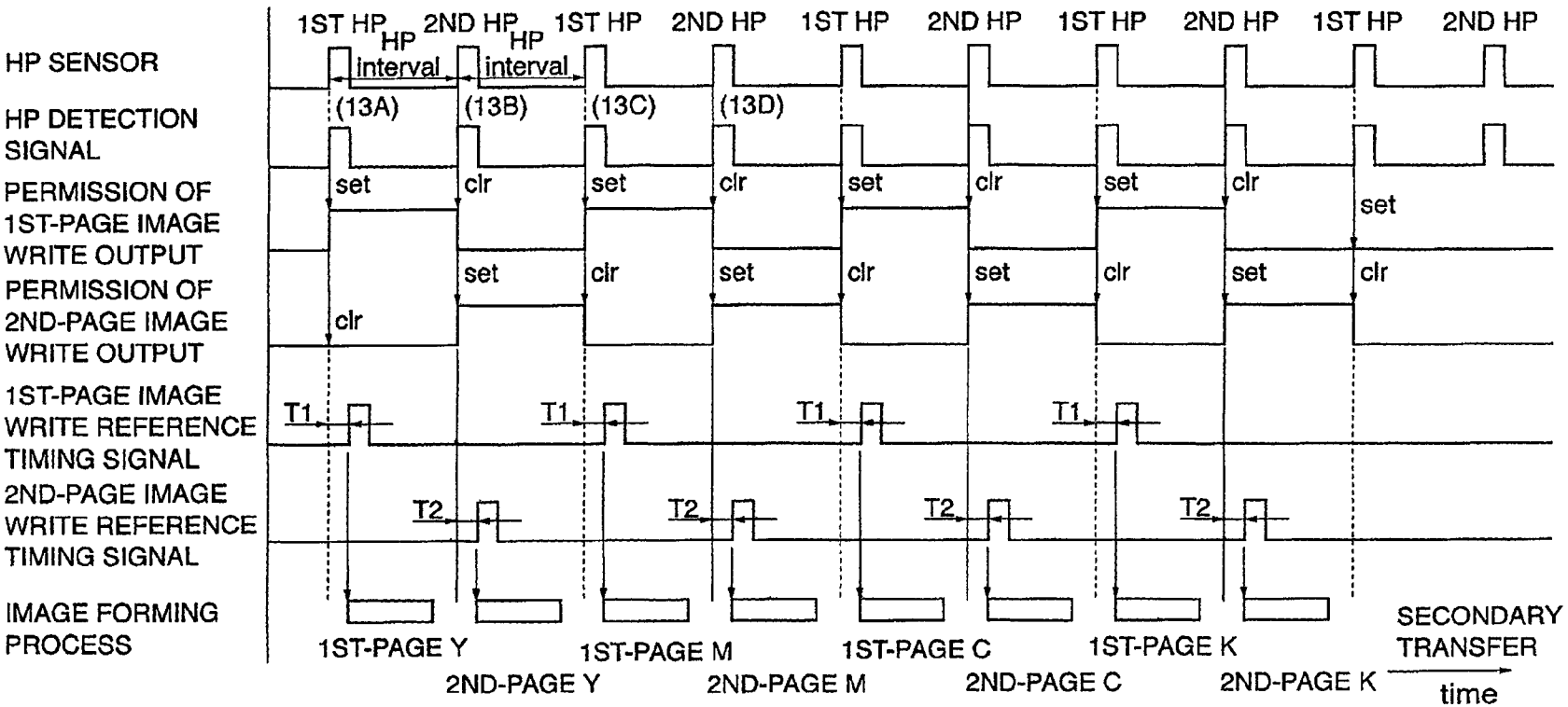
FIG. 13 is a timing diagram useful in explaining processing for forming full-color images corresponding to respective two pages on the intermediate transfer member in the non-limited-function mode in the second embodiment.

Next, processing for forming two pages of full-color images on the intermediate transfer member 205 in a non-limited-function mode (normal mode) in the second embodiment will be described with reference to a timing diagram in FIG. 13. In the second embodiment, it cannot be determined which of the first and second HP marks 1101 and 1102 was detected by the mark sensor 1103. Therefore, in the following, for the simplicity of description, there will be described a case where the first HP mark 1101 is detected first. In actuality, however, even when the second HP mark 1102 is detected first, the image forming process is carried out in the same manner as when the first HP mark 1101 is detected first.

When the first HP mark 1101 is detected by the mark sensor 1103 (13A), the CPU 601 of the printer control section 250 inhibits the ASIC 602 from outputting the second-page image write reference timing signal and permits the same to output the first-page image write reference timing signal. In this case, when the write start time period T1 before the start of writing of a first-page image has been counted, the ASIC 602 outputs the first-page image write reference timing signal to the general control section 100 via the CPU 601.

The general control section 100 outputs first-page yellow image data to the printer control section 250 based on the first-page image write reference timing signal. Under the control of the CPU 601, the ASIC 602 of the printer control section 250 drives the laser scanner 201 to form an electrostatic latent image for a first-page yellow image on the photosensitive drum 202 based on the first-page yellow image data, develop the electrostatic latent image by yellow toner, and then primarily transfer the yellow toner image onto the intermediate transfer member 205.

Next, when the second HP mark 1102 is detected by the mark sensor 1103 (13B), the CPU 601 of the printer control section 250 inhibits the ASIC 602 from outputting the first-page image write reference timing signal and permits the same to output the second-page image write reference timing signal. In this case, when the write start time period T2 before the start of writing of a second-page image has been counted, the ASIC 602 outputs the second-page image write reference timing signal to the general control section 100 via the CPU 601.

The general control section 100 outputs second-page yellow image data to the printer control section 250 based on the second-page image write reference timing signal. Under the control of the CPU 601, the ASIC 602 of the printer control section 250 drives the laser scanner 201 to form an electrostatic latent image for a second-page yellow image on the photosensitive drum 202 based on the second-page yellow image data, develop the electrostatic latent image by yellow toner, and then primarily transfer the yellow toner image onto the intermediate transfer member 205.

Next, when the first HP mark 1101 is detected by the mark sensor 1103 (13C), the CPU 601 of the printer control section 250 inhibits the ASIC 602 from outputting the second-page image write reference timing signal and permits the same to output the first-page image write reference timing signal. In this case, when the write start time period T1 before the start of writing of a first-page image has been counted, the ASIC 602 outputs the first-page image write reference timing signal to the general control section 100 via the CPU 601, whereby a first-page magenta toner image is primarily transferred onto the intermediate transfer member 205 in a manner superimposed on the first-page yellow toner image.

Next, when the second HP mark 1102 is detected by the mark sensor 1103 (13D), the CPU 601 of the printer control section 250 inhibits the ASIC 602 from outputting the first-page image write reference timing signal and permits the same to output the second-page image write reference timing signal. In this case, when the write start time period T2 before the start of writing of a second-page image has been counted, the ASIC 602 outputs the second-page image write reference timing signal to the general control section 100 via the CPU 601, whereby a second-page magenta toner image is primarily transferred onto the intermediate transfer member 205 in a manner superimposed on the second-page yellow toner image.

Similarly, first-page cyan and black toner images and second-page cyan and black toner images are respectively primarily transferred onto the intermediate transfer member 205 in superimposed relation. Then, after completion of the primary transfer of the second-page black toner image, the CPU 601 of the printer control section 250 inhibits the ASIC 602 from outputting the first-page and second-page image write reference timing signals and instructs the same to sequentially secondarily transfer the first-page and second-page full-color images on the intermediate transfer member 205 to respective recording sheets.

As described above, in the non-limited-function mode (normal mode), a first-page full-color image is formed using a detection signal associated with one of the first HP mark 1101 and the second HP mark 1102 which is detected first, and a second-page full-color image is formed using a detection signal associated with the other of the first HP mark 1101 and the second HP mark 1102 which is detected next.

Next, processing for forming a full-color image on the intermediate transfer member 205 in the limited-function mode in the second embodiment will be described with reference to a timing diagram in FIG. 14.

Figure 14:
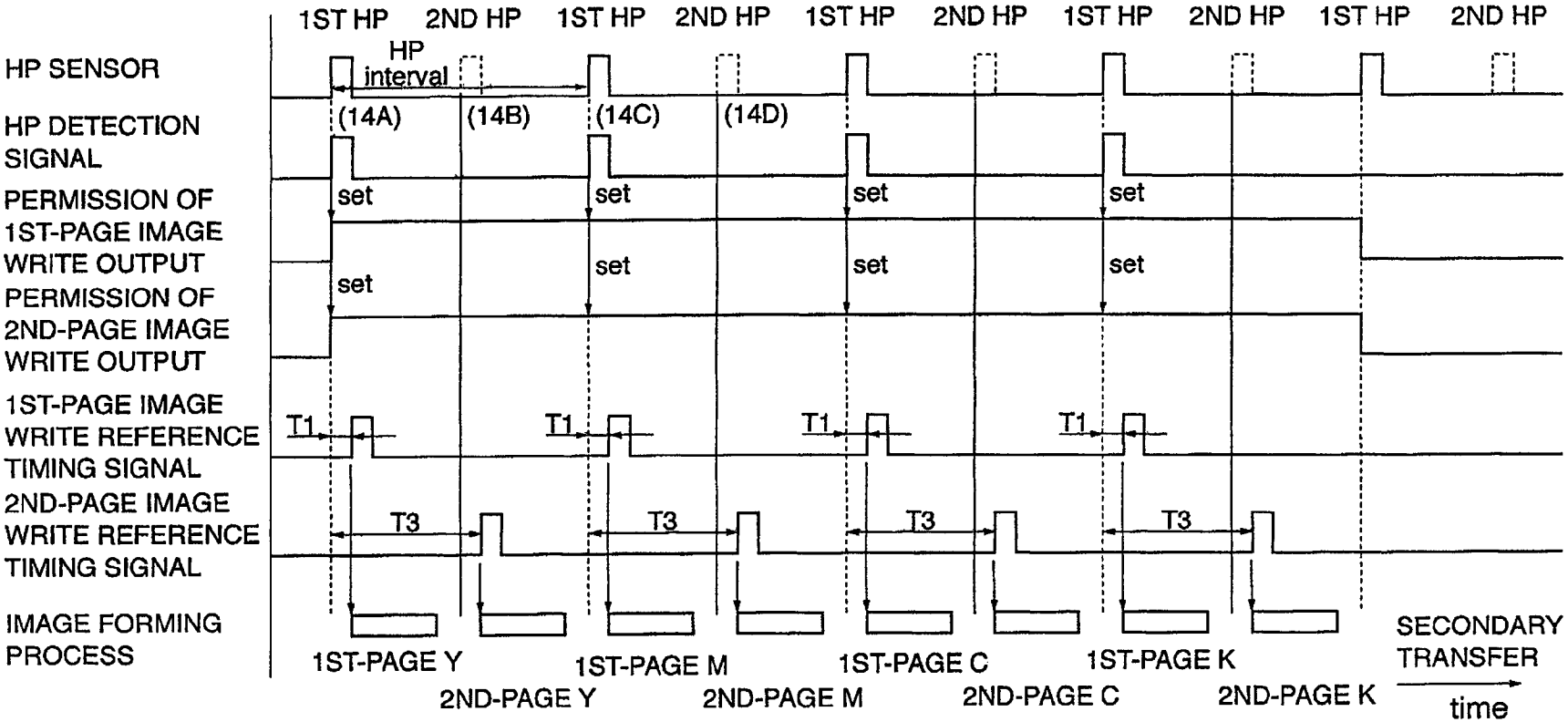
FIG. 14 is a timing diagram useful in explaining processing for forming full-color images corresponding to respective two pages on the intermediate transfer member in the limited-function mode in the second embodiment.

It should be noted that FIG. 14 corresponds to the case where the detected state of the second HP mark 1102 is abnormal and that of the first HP mark 1101 is normal. Further, in the second embodiment, it cannot be determined which of the first and second HP marks 1101 and 1102 was detected by the mark sensor 1103. Therefore, in the following, for the simplicity of description, there will be described a case where the first HP mark 1101 is detected first and then an abnormality in detection of the second HP mark 1102 is determined. In actuality, however, even when the second HP mark 1102 is detected first and then an abnormality in detection of the first HP mark 1101 is determined, the image forming process is carried out in the same manner as when the first HP mark 1101 is detected first. In the second embodiment, when either one of the HP marks is normally detected, an image writing reference timing signal is output based on the normally detected HP mark. For the undetected HP mark, an alternate signal as image writing reference timing signal is generated based on the normally detected HP mark.

When the first HP mark 1101 is detected by the mark sensor 1103 (14A), the CPU 601 of the printer control section 250 permits the ASIC 602 to output the first-page and second-page image write reference timing signals. Further, the CPU 601 sets to the ASIC 602 a write start time period T3 from the start of writing of a first-page image (actually, the time of detection of the first HP mark 1101 detected first) to the start of writing of a second-page image. Then, the CPU 601 instructs the ASIC 602 to count the write start time period T1 before the start of writing of the first-page image and the write start time period T3 before the start of writing of the second-page image. The write start time period T3 is stored in the RAM 604.

The write start time period T3 is predetermined such that it starts simultaneously with the write start time period T1 and ends simultaneously with the time period T2 from detection of the second HP mark 1102 whose detected state is determined to be abnormal to the start of writing of a second-page image. The time period T3 is used to determine alternative timing corresponding to timing determined based on the time period T2.

In this case, when the write start time period T1 before the start of writing of the first-page image has been counted, the ASIC 602 outputs the first-page image write reference timing signal to the general control section 100 via the CPU 601.

The general control section 100 outputs first-page yellow image data to the printer control section 250 based on the first-page image write reference timing signal. Under the control of the CPU 601, the ASIC 602 of the printer control section 250 drives the laser scanner 201 to form an electrostatic latent image for a first-page yellow image on the photosensitive drum 202 based on the first-page yellow image data, develop the electrostatic latent image by yellow toner, and then primarily transfer the yellow toner image onto the intermediate transfer member 205.

At this time, since the detected state of the second HP mark 1102 is abnormal, the CPU 601 stops operation for reading the detection signal associated with even-numbered HP marks from the mark sensor 1103 (see 14B and 14D). Further, the CPU 601 has already permitted the ASIC 602 to output the second-page image write reference timing signal and set to the ASIC 602 the write start time period T3 from the start of writing of the first-page image (actually, the time of detection of the first HP mark 1101 detected first) to the start of writing of the second-page image.

When the write start time period T3 has been counted, the ASIC 602 outputs the second-page image write reference timing signal to the general control section 100 via the CPU 601.

The general control section 100 outputs second-page yellow image data to the printer control section 250 based on the second-page image write reference timing signal. Under the control of the CPU 601, the ASIC 602 of the printer control section 250 drives the laser scanner 201 to form an electrostatic latent image for a second-page yellow image on the photosensitive drum 202 based on the second page yellow image data, develop the electrostatic latent image by yellow toner, and then primarily transfer the yellow toner image onto the intermediate transfer member 205.

Next, when the first HP mark 1101 is detected by the mark sensor 1103 (14C), the CPU 601 of the printer control section 250 instructs the ASIC 602 to count the write start time period T1 before the start of writing of a first-page image and the write start time period T3 before the start of writing of a second-page image.

In this case, when the write start time period T1 before the start of writing of a first-page image has been counted, the ASIC 602 outputs the first-page image write reference timing signal to the general control section 100 via the CPU 601, and the general control section 100 outputs first-page magenta image data to the printer control section 250 based on the first-page image write reference timing signal. The ASIC 602 of the printer control section 250 drives the laser scanner 201, under the control of the CPU 601, to form an electrostatic latent image for a first-page magenta image on the photosensitive drum 202 based on the first-page magenta image data, develop the electrostatic latent image by magenta toner, and then primarily transfer the first-page magenta toner image onto the intermediate transfer member 205 in a manner superimposed on the first-page yellow toner image.

Then, when the write start time period T3 from the start of writing of a first-page image to the start of writing of a second-page image has been counted, the ASIC 602 outputs the second-page image write reference timing signal to the general control section 100 via the CPU 601.

The general control section 100 outputs second-page magenta image data to the printer control section 250 based on the second-page image write reference timing signal. Then, the ASIC 602 of the printer control section 250 drives the laser scanner 201, under the control of the CPU 601, to form an electrostatic latent image for a second-page magenta image on the photosensitive drum 202 based on the second-page magenta image data, develop the electrostatic latent image by magenta toner, and then primarily transfer the second-page magenta toner image onto the intermediate transfer member 205 in a manner superimposed on the second-page yellow toner image.

Similarly, first-page cyan and black toner images and second-page cyan and black toner images are respectively primarily transferred onto the intermediate transfer member 205 in superimposed relation. Then, after completion of the primary transfer of the second-page black toner image, the CPU 601 of the printer control section 250 inhibits the ASIC 602 from outputting the first-page and second-page image write reference timing signals and instructs the same to sequentially secondarily transfer the first-page and second-page full-color images on the intermediate transfer member 205 to respective recording sheets.

As described above, according to the second embodiment, in the limited-function mode set when the detected state of one HP mark has become abnormal, a first-page full-color image is formed on the intermediate transfer member 205 using a detection signal associated with the other HP mark normally detected. Further, an alternate signal taking the place of a detection signal associated with the abnormally detected HP mark is generated based on the normally detected HP mark, and a second-page full-color image is formed on the intermediate transfer member 205 using the alternate signal.

Thus, the second embodiment makes it possible to form a second-page full-color image on the intermediate transfer member 205 even when the detected state of one HP mark has become abnormal, which prevents reduction of the productivity of the image forming apparatus. However, since the second-page full-color image is formed using the alternate signal, irregular rotation or the like of the intermediate transfer member 205 which can possibly occur in the image forming apparatus might cause minute color displacement. To avoid this problem, when it is desired to realize image formation without possibility of occurrence of color displacement even if reduction of the productivity of the image forming apparatus is caused, a method may be employed in which a button for a limited-function mode different from the above described limited-function mode is provided on the function limitation setting screen in FIG. 8B, to allow the user to select the different limited-function mode, whereby only outputs indicative of normal HP mark detection may be used for image formation as shown in FIG. 10. In this case, a second-side write permitting signal in FIG. 14, i.e. the second-page image write reference timing signal, and the write start time period T3 are not output.

It should be noted that when the detected states of the respective first and second HP marks are both abnormal, the apparatus may be stopped due to abnormality, for example, without displaying such a function limitation setting screen as shown in FIG. 8B. Further, an alternate signal can be generated not based on a detection signal associated with a normally detected HP mark, but based on an arbitrary signal. As will be described concerning other embodiments, the arbitrary signal is generated from a time at which the rotation of the intermediate transfer belt becomes stable after the start of image formation, and used for color image formation or monochrome image formation.

Furthermore, the second embodiment can also be applied to the case where three or more HP marks are marked on the intermediate transfer member. In this case, it is only required to control the image formation timing such that a first-page image is formed on the intermediate transfer member using a detection signal associated with an HP mark whose detected state was determined to be normal, and at the same time an alternate signal (timing signal) to a detection signal associated with an HP mark whose detected state was determined to be abnormal is generated, whereby the alternate signal is used to form on the intermediate transfer member an image corresponding to a detection signal associated with an HP mark whose detected state is determined to be abnormal in image forming processes for a second-page image et seq.

Figure 15:
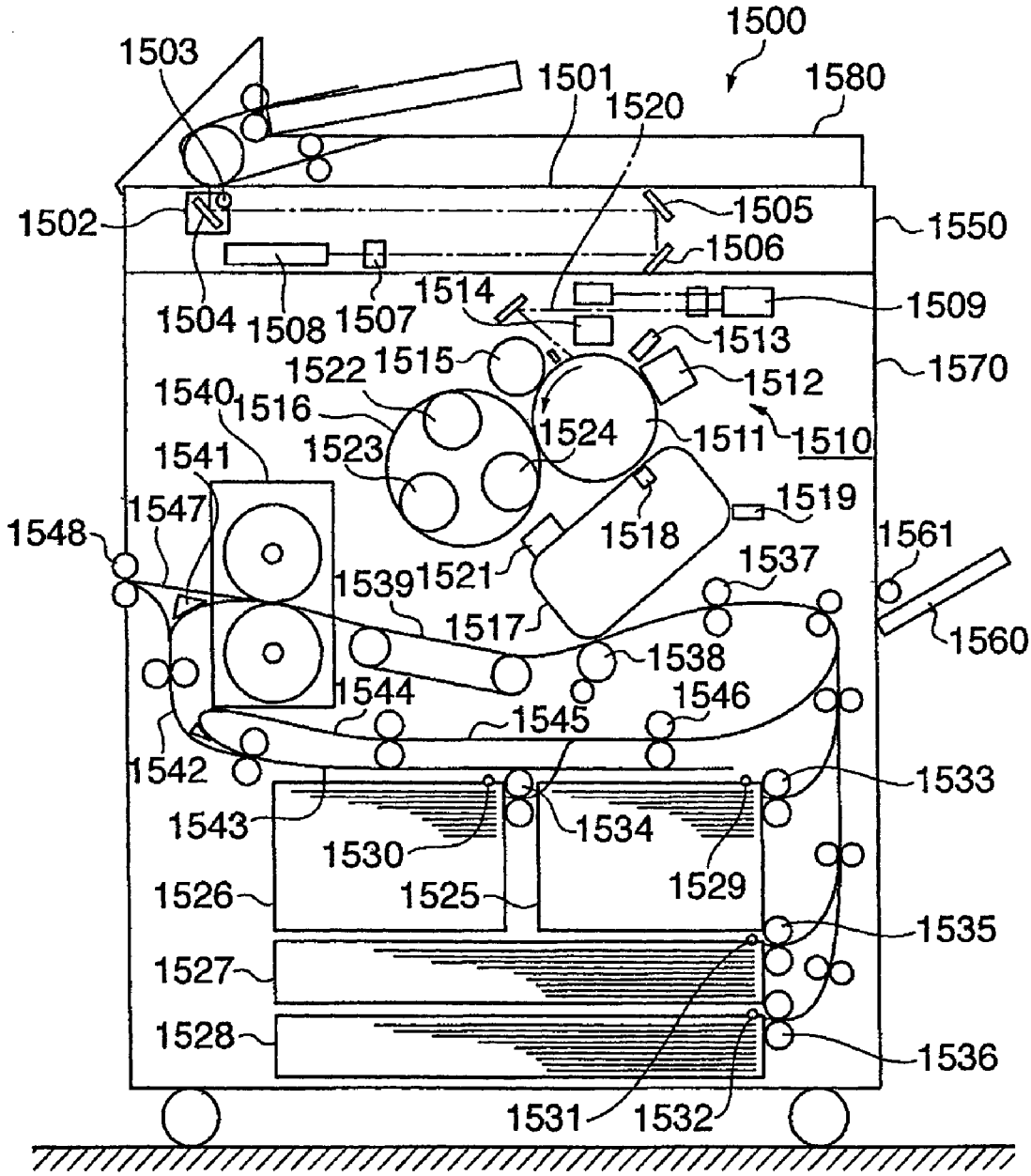
FIG. 15 is a view showing the internal construction of an image forming apparatus according to a third embodiment of the present invention.

Next, a description will be given of the whole arrangement of an image forming apparatus according to a third embodiment of the present invention. FIG. 15 is a view schematically showing the internal construction of the image forming apparatus 1500 according to the third embodiment. The image forming apparatus 1500 is comprised of a digital color image reader section (hereinafter simply referred to as "the reader section") 1550 corresponding to an upper part of a casing and a digital color image printer section (hereinafter simply referred to as "the printer section") 1570 corresponding to a lower part of the casing.

On the reader section 1550, there is mounted an original feeder 1580. Further, a post processing unit, not shown, can be attached to the printer section 1570. The post processing unit performs various types of post-processing including a stapling process for stapling recording materials. Further, the image forming apparatus 1500 is capable of exchanging data with a host computer and other external apparatuses via a network communication interface, not shown.

The original feeder 1580 includes an original stacker on which an original bundle for copying is placed, and an original feed mechanism which is configured to be capable of feeding originals one by one from the original bundle placed on the original stacker onto an original platen glass 1501 and discharge each of the originals from the original platen glass 1501 after completion of reading. It should be noted that originals can be manually set on the original platen glass 1501.

The reader section 1550 is comprised of the original platen glass 1501, a scanner unit 1502, scanning mirrors 1505 and 1506, a lens 1507, and a full-color image sensor unit 1508. The scanner unit 1502 is comprised of an original illuminating lamp 1503 and a scanning mirror 1504. The full-color image sensor unit 1508 has a CCD sensor integrally formed with 3-color (R, G, and B) separation filters.

The scanner unit 1502 is driven by a motor, not shown, to reciprocate for scanning in a predetermined direction. The original illuminating lamp 1503 is a light source that emits light onto an original. An original placed on the original platen glass 1501 is irradiated with light from the original illuminating lamp 1503, and a reflected light image from the original is formed on the CCD sensor within the full-color image sensor unit 1508 via the scanning mirrors 1504 to 1506 and the lens 1507. Then, analog signals of the image color-separated into three colors of R, G, and B are output from the CCD sensor and amplified by an amplifier circuit, not shown, followed by being converted into digital signals.

The printer section 1570 includes an image forming section 1510. The image forming section 1510 is comprised of an exposure section 1509, a photosensitive drum 1511, a cleaning device 1512, a pre-exposure lamp 1513, a primary electrostatic charger 1514, a black developing device 1515, a rotary color developing device 1516, an intermediate transfer belt 1517, a primary transfer electrostatic charger 1518, and a cleaning device 1521.

The exposure control section 1509 is provided with a semiconductor laser, not shown, as a laser beam generator, a polygon scanner, not shown, and so forth. The exposure control section 1509 generates a laser beam 1520 modulated based on an image signal converted into an electric signal by the color image sensor unit 1508 and having undergone predetermined image processing, and irradiates the photosensitive drum 1511 with the laser beam 1520.

The photosensitive drum 1511 functions as an image carrier. More specifically, the photosensitive drum 1511 is driven by a motor, not shown, for counterclockwise rotation as viewed in FIG. 15, is destaticized by the pre-exposure lamp 1513, and is then uniformly charged to a predetermined potential by the primary electrostatic charger 1514, whereafter the photosensitive drum 1511 is irradiated with the laser beam 1520 emitted from the exposure control section 1509, whereby an electrostatic latent image (hereinafter simply referred to as "a latent image") is formed on the surface of the photosensitive drum 1511. The latent image formed on the surface of the photosensitive drum 1511 is developed into a toner image by the rotary color developing device 1516 or the black developing device 1515.

It should be noted that the photosensitive drum 1511 has the property that in development, toner adheres not to a portion of the photosensitive drum 1511 irradiated with the laser beam 1520, but to a portion of the same which was not irradiated with the laser beam 1520. This means that as the laser beam 1520 emitted onto the photosensitive drum 1511 is stronger, toner density becomes lower, and as the laser beam 1520 is weaker, toner density becomes higher.

The rotary color developing device 1516 has developing devices 1522, 1523, and 1524 corresponding to yellow, magenta, and cyan, respectively. In the case of color image development, the rotary color developing device 1516 is rotated by a motor, not shown, to thereby selectively bring one of the developing devices 1522 to 1524 closer to the photosensitive drum 1511 according to an associated color component to be developed. On the other hand, black monochrome image development is performed using the black developing device 1515 disposed at a location close to the photosensitive drum 1511.

A toner image on the photosensitive drum 1511 is primarily transferred onto the intermediate transfer belt 1517 by a bias (primary transfer bias) applied to the intermediate transfer belt 1517 by the primary transfer electrostatic charger 1518. In the case of color image formation, toner images in the respective four colors are primarily transferred onto the intermediate transfer belt 1517 in superimposed relation, while in the case of black monochrome image formation, only a black toner image is primarily transferred onto the intermediate transfer belt 1517.

It should be noted that when the longitudinal dimension of a recording material, such a recording sheet, as an image forming medium is not larger than half the circumference of the intermediate transfer belt 1517, images corresponding to respective two recording materials can be simultaneously formed on the intermediate transfer belt 1517. Further, after completion of primary transfer, residual toner remaining on the surface of the photosensitive drum 1511 is cleaned by a blade, not shown, provided in the cleaning device 1512, and then the photosensitive drum 1511 is used for a succeeding image forming process.

The printer section 1570 includes not only the image forming section 1510, but also a registration roller 1537, a secondary transfer roller 1538, a conveyor belt 1539, a heating roller fixing device (hereinafter simply referred to as "the fixing device") 1540, a discharge flapper 1541, a right cassette deck 1525, a left cassette deck 1526, an upper cassette deck 1527, a lower cassette deck 1528, a conveying path 1547, a conveying path 1542, an inverting path 1543, a lower conveying path 1544, a refeed path 1545, a refeed roller 1546, a discharge roller 1548, and a manual tray 1560.

For example, a recording material contained in the right cassette deck 1525 is fed by a pickup roller 1529 and a feed roller 1533 and then conveyed by the registration roller 1537 to the secondary transfer position, where a toner image on the intermediate transfer belt 1517 is secondarily transferred onto the recording material.

Similarly, a recording material contained in the left cassette deck 1526 is fed by a pickup roller 1530 and a feed roller 1534. Further, a recording material contained in the upper cassette deck 1527 is fed by a pickup roller 1531 and a feed roller 1535. Furthermore, a recording material contained in the lower cassette deck 1528 is fed by a pickup roller 1532 and a feed roller 1536. Each recording material fed from the associated cassette deck is conveyed to the secondary transfer position by the registration roller 1537. In the case of manual feed, a recording material set on the manual tray 1560 is fed by a feed roller 1561.

After a toner image on the photosensitive drum 1511 has been primarily transferred onto the intermediate transfer belt 1517 in the image forming section 1510, a recording material having been conveyed to the position of the registration roller 1537 is conveyed to the secondary transfer position where the secondary transfer roller 1538 is positioned. A secondary transfer bias is applied to the secondary transfer roller 1538 in timing synchronous with the conveyance of the recording material to the secondary transfer position, whereby a toner image on the intermediate transfer belt 1517 is secondarily transferred onto the recording material. After completion of secondary transfer, residual toner remaining on the intermediate transfer belt 1517 is cleaned by a blade, not shown, provided in the cleaning device 1521, and then the intermediate transfer belt 1517 is used for a succeeding image forming process.

It should be noted that in the present embodiment, a gap between the intermediate transfer belt 1517 and the secondary transfer roller 1538 can be set, as desired, by operating an eccentric cam, not shown, in desired timing. In the present example, in the case of primarily transferring toner images in a plurality of colors onto the intermediate transfer belt 1517 in superimposed relation, a gap is created between the intermediate transfer belt 1517 and the secondary transfer roller 1538, whereas in the case of secondarily transferring a toner image onto a recording material, the gap is eliminated. In the case of forming a black monochrome image, the gap is not created. On the other hand, during standby or in a power-off mode, the gap is created.

After completion of secondary transfer, the recording material having the toner image formed thereon is conveyed to the fixing device 1540 by the conveyor belt 1539, and the toner image on the recording sheet is fixed by being pressed and heated by the fixing device 1540. Normally, the recording material having undergone fixing processing is discharged by the discharge roller 1548 through the conveying path 1547 into a recording material discharge section, not shown, externally attached to the image forming apparatus 1500.

The discharge flapper 1541 switches the direction of delivery of a recording material having undergone toner image fixing processing toward the conveying path 1542 or toward the discharge roller 1548. In the case of forming an image on one side of the recording material, the discharge flapper 1541 is set such that the recording material is delivered toward the discharge roller 1548. In the case of forming images on both sides of the recording material, respectively, the discharge flapper 1541 is set such that the recording material is delivered toward the conveying path 1542. In this case, the recording material conveyed to the conveying path 1542 is further conveyed to the lower conveying path 1544 via the inverting path 1543 to be guided to the refeed path 1545. This recording material is inverted upside down by being passed through the inverting path 1543 and the lower conveying path 1544. When a recording material is to be discharged from the image forming apparatus 1500 in an inverted state, the discharge flapper 1541 is set such that the recording material is delivered toward the conveying path 1542. In this case, the recording material is conveyed into the inverting path 1543, and then an inverting roller is driven for reverse rotation to thereby convey the recording material to the discharge roller 1548.

Figure 16:
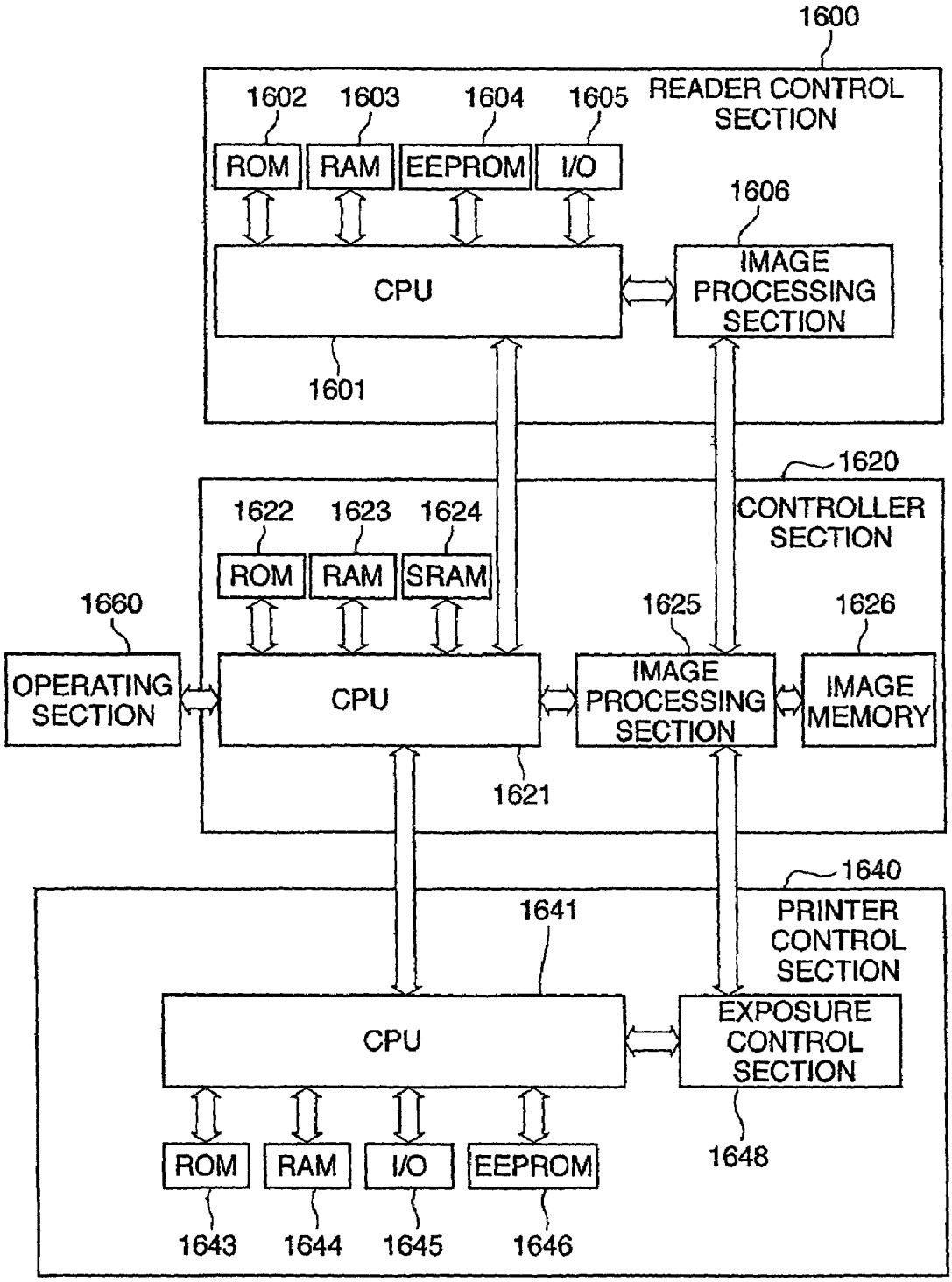
FIG. 16 is a block diagram of a control section of the image forming apparatus in FIG. 15.

Next, the configuration of control sections of the image forming apparatus 1500 will be described with reference to FIG. 16. Referring to FIG. 16, a reader control section 1600 controls the original feeder 1580 and the reader section 1550. The reader control section 1600 basically controls feeding of originals and image reading operation. A CPU 1601 of the reader control section 1600 controls the overall operation of the original feeder 1580 and the reader section 1550. A ROM 1602 stores procedures (control programs) of controlling the original feeder 1580 and the reader section 1550.

A RAM 1603 which functions as a main storage of the CPU 1601 is used as an input data storage area, a working storage area, and so forth. An EEPROM 1604 stores data and the like for use in carrying out various types of image processing in an image processing section 1606, described hereinafter.

An input/output IC (hereinafter simply referred to as "the I/O") 1605 outputs control signals from the CPU 1601 to loads, such as motors, and transfers signals from sensors and the like to the CPU 1601. The image processing section 1606 performs image processing including shading correction on image data read by the CCD sensor within the full-color image sensor unit 1508, and sends the image data having undergone the image processing to a controller section 1620, described below.

The controller section 1620 controls the overall operation of the image forming apparatus 1500 while giving instructions to the reader control section 1600 and a printer control section 1640. A CPU 1621 of the controller section 1620 controls the overall operation of the image forming apparatus 1500. A ROM 1622 stores a procedure (control program) of controlling the image forming apparatus 1500, and the CPU 1621 controls the component elements of the image forming apparatus 1500 based on the control program stored in the ROM 1622. A RAM 1623 which functions as a main storage of the CPU 1621 is used as an input data storage area, a working storage area, and so forth.

It should be noted that the CPU 1621 receives an operation signal from each of various keys in an operating section 1660 and carries out processing associated with the key. Further, the CPU 1621 outputs a display signal indicative of information to be displayed on a display panel of the operating section 1660.

A SRAM 1624 powered by a battery, not shown, holds data, such as adjustment values and a total number of printed sheets, which are required to be saved even after a main power supply is turned off. An image processing section 1625 performs image processing, such as magnification/reduction, compression, or decompression, on image data transmitted from the reader control section 1600 or an external apparatus, not shown, and then sends the image data having undergone the image processing to the printer control section 1640. Image memory 1626 comprises a memory which can send and receive image data to and from the image processing section 1625.

The printer control section 1640 controls the printer section 1570 to control sequential operations for forming an image on a recording material. More specifically, the printer control section 1640 controls conveyance of a recording material, formation of a latent image on the photosensitive drum 1511 and development of the latent image by toner, primary transfer of the developed toner image onto the intermediate transfer belt 1517, secondary transfer of the toner image on the intermediate transfer belt 1517 to the recording material, fixing of the toner image on the recording material, and the like operations.

A CPU 1641 of the printer control section 1640 controls the overall operation of the printer control section 1640. A ROM 1643 stores a procedure (control program) of controlling the printer section 1570, and the CPU 1641 controls the component elements of the printer section 1570 based on the control program stored in the ROM 1643. A RAM 1644 which functions as a main storage of the CPU 1641 is used as an input data storage area, a working storage area, and so forth.

It should be noted that the CPU 1641 of the printer control section 1640 performs control of image formation timings shown in FIGS. 18A, 18B, 19A, 19B, 21 and 22, respectively, based on the control program stored in the ROM 1643.

An I/O 1645 outputs control signals from the CPU 1641 to loads, such as motors, and transfers signals from a mark sensor (designated by reference numeral 1701 in FIG. 17) and the like to the CPU 1641. An EEPROM 1646 stores data for use in exposure control by an exposure control section 1648, described below.

The exposure control section 1648 modulates the laser beam 1520 emitted from the exposure section 1509, based on image data sent from the image forming section 1625 of the controller section 1620, to thereby form a latent image corresponding to the image data on the photosensitive drum 1511.

Figure 17:
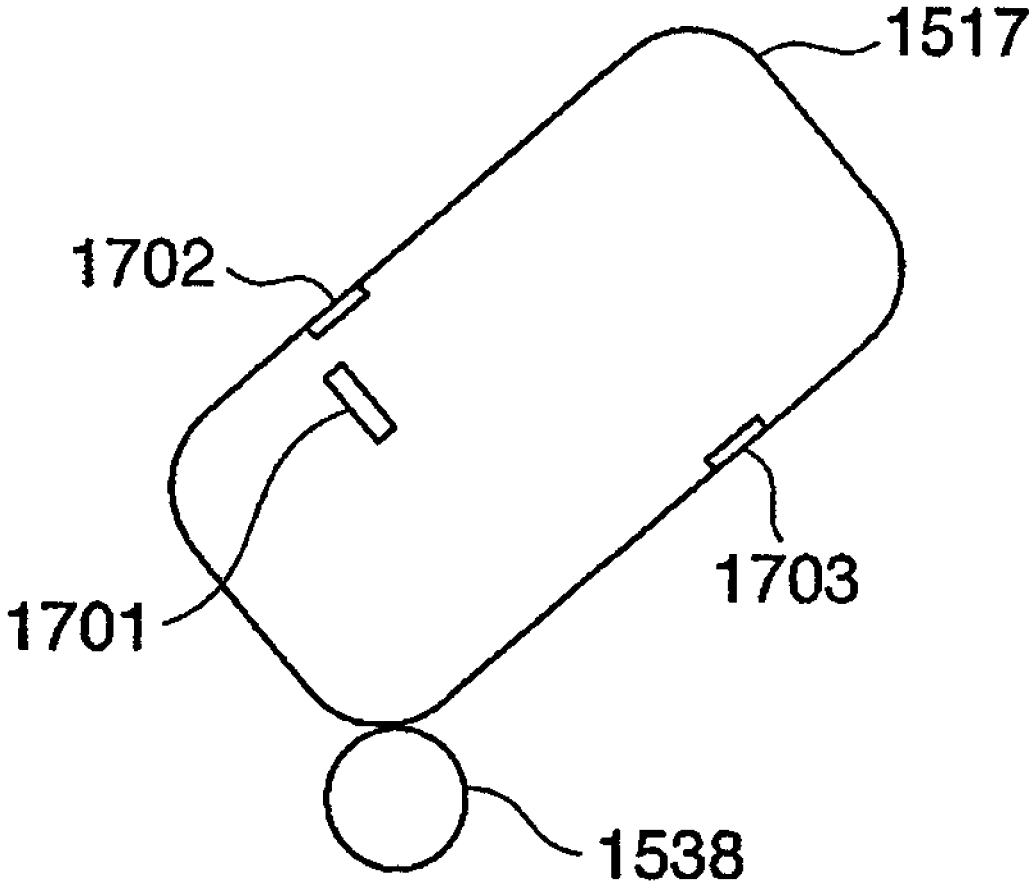
FIG. 17 is a view showing the construction of an intermediate transfer member of the image forming apparatus in FIG. 15.

FIG. 17 is a view showing in detail the construction of the intermediate transfer belt 1517 of the printer section 1570. As shown in FIG. 17, the intermediate transfer belt 1517 has an inner peripheral surface thereof marked with HP marks 1702 and 1703 each indicative of a reference position (home position). The HP marks 1702 and 1703 are marked at respective locations separated from each other by half the circumference of the intermediate transfer belt 1517. Further, within the intermediate transfer belt 1517, there is provided a mark sensor 1701 for detecting the HP marks 1702 and 1703.

As the intermediate transfer belt 1517 is rotated by a motor, not shown, for image formation, the HP marks 1702 and 1703 are alternately detected by the mark sensor 1701. An output signal (mark detection signal) from the mark sensor 1701 is input to the CPU 1641 via the I/O 1645 of the printer control section 1640, and is used for determination of image formation timing (latent image formation start timing).

Figure 18A:
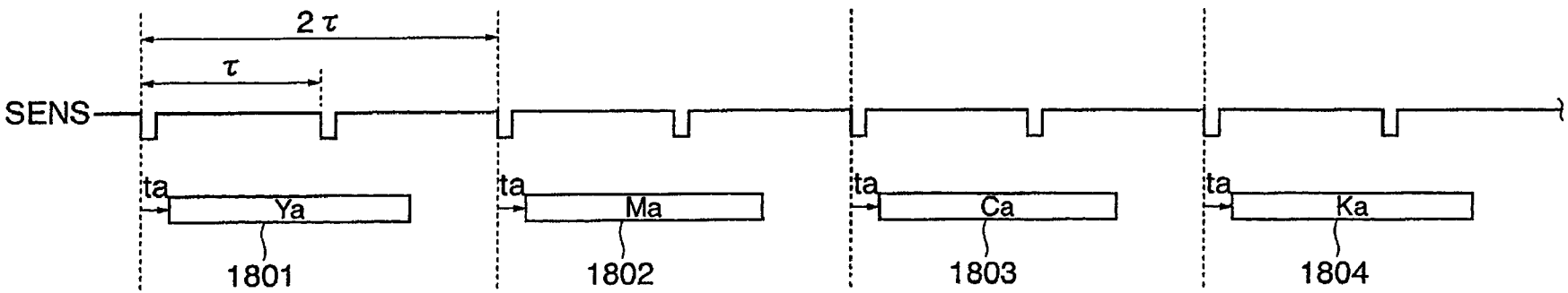
FIG. 18A is a timing diagram showing control of image formation timing based on a mark detection signal, which is executed for one-page image formation.
Figure 18B:
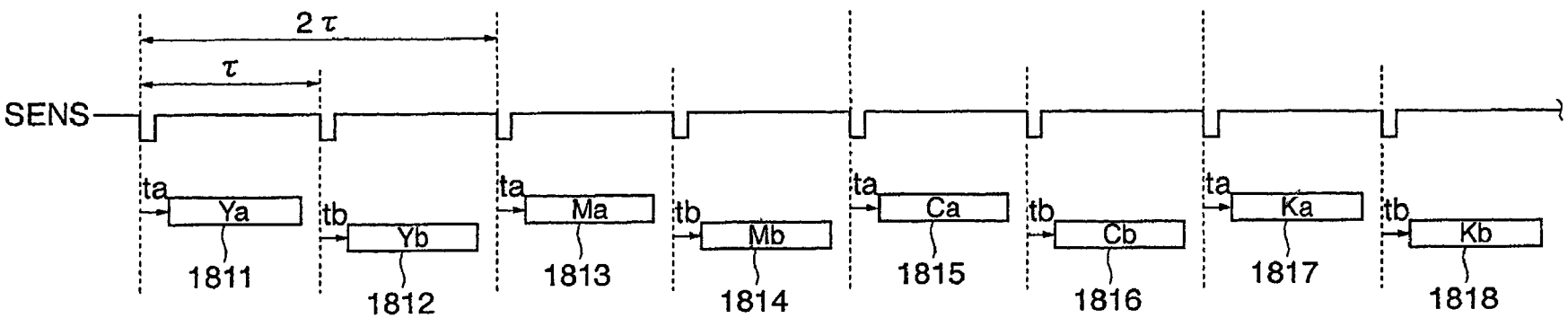
FIG. 18B is a timing diagram showing control of image formation timing based on mark detection signals, which is executed for two-page simultaneous image formation.

FIGS. 18A and 18B are timing diagrams showing a method of determining the latent image formation start timing using the mark detection signal. In FIGS. 18A and 18B, a symbol "SENS" represents the mark detection signal. Insofar as the mark sensor 1701 detects the HP mark 1702 or 1703, the mark detection signal "SENS" is held low.

A symbol "τ" appearing in FIGS. 18A and 18B represents a time period from a time point when one of the HP marks is detected to a time point when the other HP marks is detected, i.e. a time period taken for a half rotation of the intermediate transfer belt 1517. The HP marks 1702 and 1703 are alternately detected, as described hereinabove, and the order of detection is not limited.

FIG. 18A shows the image formation timing (latent image formation start timing) in the case where the longitudinal dimension of a recording material is not smaller than half the circumferential length of the intermediate transfer belt 1517. In this case, the CPU 1641 controls the image formation timing using as a reference a time of detection of one of the two HP marks 1702 and 1703 detected first by the mark sensor 1701 after stabilization of rotation of the motor rotating the intermediate transfer belt 1517, i.e. using a time of detection of the HP mark 1702 as a reference, for example.

The CPU 1641 starts forming a latent image associated with each of the colors Y, M, C, and K upon the lapse of a predetermined time period (ta) after detection of the HP mark 1702 as a reference, whereby toner images 1801, 1802, 1803, and 1804 in the respective colors are primarily transferred onto the intermediate transfer belt 1517 in superimposed relation. The CPU 1641 starts counting the time period 2τ in response to the HP mark 1702 being first detected, and upon completion of the counting, determines the HP mark 1702 again. Alternatively, when the HP mark is counted twice in total after the HP mark 1702 was first detected, the CPU 1641 determines the HP mark 1702 again.

FIG. 18B shows the image formation timing (latent image formation start timing) in the case where the longitudinal dimension of a recording material is smaller than half the circumferential length of the intermediate transfer belt 1517. In this case, images corresponding to two sheets of recording materials, i.e. images corresponding to two pages are simultaneously formed on the intermediate transfer belt 1517 by making use of the two HP marks 1702 and 1703.

In this case, the CPU 1641 controls image formation timing corresponding to a first sheet of the recording materials, using as a reference a time of detection of one of the two HP marks 1702 and 1703 detected first by the mark sensor 1701 after stabilization of rotation of the motor rotating the intermediate transfer belt 1517, i.e. using a time of detection of the HP mark 1702 as a reference. The CPU 1641 controls image formation timing corresponding to a second sheet of the recording materials, using a time of detection of the other HP mark 1703 as a reference.

The CPU 1641 starts forming a latent image corresponding to the first sheet in association with each of the colors Y, M, C, and K upon the lapse of a predetermined time period (ta) after detection of the HP mark 1702 as a reference, whereby toner images 1811, 1813, 1815, and 1817 in the respective colors corresponding to the first sheet are primarily transferred onto the intermediate transfer belt 1517 in superimposed relation. Further, the CPU 1641 starts forming a latent image corresponding to the second sheet upon the lapse of a predetermined time period (tb) after detection of the HP mark 1703 as a reference, whereby toner images 1812, 1814, 1816, and 1818 in the respective colors corresponding to the second sheet are primarily transferred onto the intermediate transfer belt 1517 in superimposed relation.

Figure 19A:
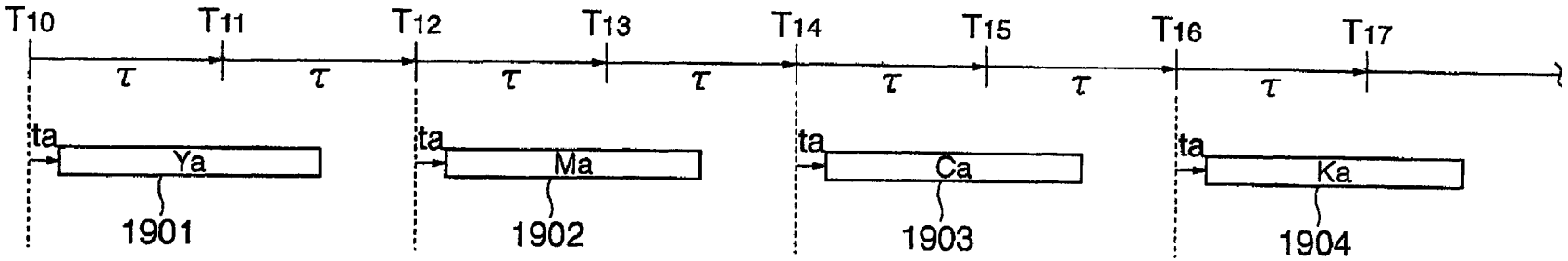
FIG. 19A is a timing diagram showing control of image formation timing based on counting of a predetermined time period by a timer, which is executed for one-page image formation.
Figure 19B:
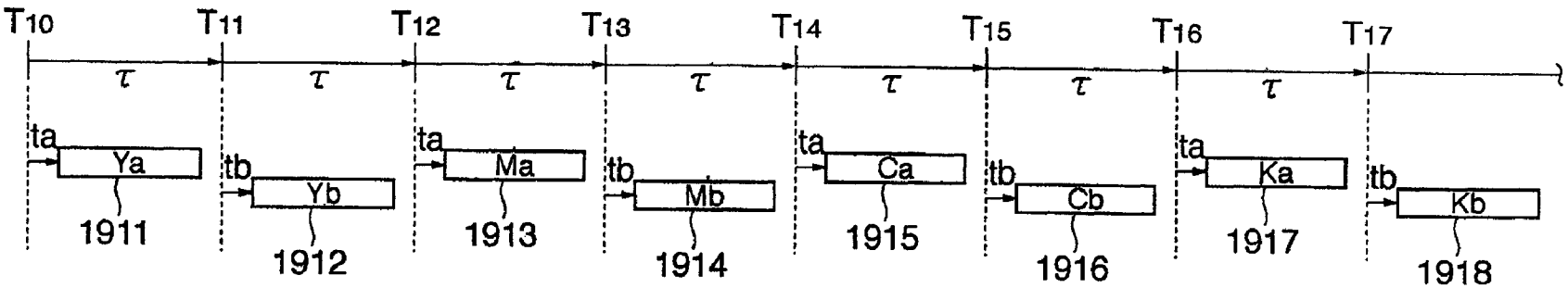
FIG. 19B is a timing diagram showing control of image formation timing based on counting of a predetermined time period by a timer, which is executed for two-page simultaneous image formation.

FIGS. 19A and 19B are timing diagrams showing a method of determining image formation timing (latent image formation start timing) without reference to the mark detection signal. FIG. 19A shows the image formation timing in the case where the longitudinal dimension of a recording material is not smaller than half the circumference of the intermediate transfer belt 1517, i.e. in the case of forming an image corresponding to one sheet of recording material on the intermediate transfer belt 1517, while FIG. 19B shows the image formation timing in the case where the longitudinal dimension of a recording material is smaller than half the circumference of the intermediate transfer belt 1517, i.e. in the case of simultaneously forming images corresponding to respective two sheets of recording material on the intermediate transfer belt 1517.

In this method, the CPU 1641 starts a timer for counting the same time period as a cycle τ of detection of the HP mark 1702 or 1703 by the mark sensor 1701, with an arbitrary time T10 set as a starting point. Latent image formation associated with a first color Ya is started upon the lapse of the time period ta after the time TIC as the starting point. When a time point (time T11) at which the time period τ has elapsed after the time T10 is detected by the timer, the same timer is restarted, or alternatively another timer of the same type is started. It should be noted that the CPU 1641 may selectively set either one of mark detection time periods τ and 2τ in the timer in accordance whether or not the longitudinal length of recording sheets is not less than half the entire circumference of the intermediate transfer belt 1517 or less than half the circumference thereof. At the time T11 (more generically, a time T1*i* (i=1, 3, 5, or 7) at which the lapse of the time period τ is detected for the i-th time after the time T10), in the case shown in FIG. 19A, the CPU 1641 issues no instruction regarding control that is implemented in association with the time period tb, whereas in the case shown in FIG. 19B, the CPU 1641 gives an instruction for starting latent image formation associated with a first color Yb for a second-sheet image upon the lapse of the predetermined time period tb after T11 (generically T1*i*).

Whenever the same time period τ as the cycle of detection of the HP mark 1702 or 1703 by the mark sensor 1701 elapses, the CPU 1641 starts the timer for counting the same time period τ. When the predetermined time period ta or tb has elapsed after completion of the counting of the timer, formation of a latent image associated with a respective color for a first-sheet or second-sheet image is started. Thus, in the case shown in FIG. 19A, the toner images 1901 to 1904 in the respective colors are primarily transferred onto the intermediate transfer belt 1517 in superimposed relation. On the other hand, in the case shown in FIG. 19B, the toner images 1911, 1913, 1915, and 1917 in the respective colors, each of which corresponds to the first sheet, are primarily transferred onto the intermediate transfer belt 1517 in superimposed relation. Further, the toner images 1912, 1914, 1916, and 1918 in the respective colors, each of which corresponds to the second sheet, are primarily transferred onto the intermediate transfer belt 1517 in superimposed relation.

In the present embodiment, for achievement of cost reduction, a software timer is used as a timer for counting predetermined time periods by the program stored in the ROM 1643. However, a timer configured as an external unit of the CPU 1641 may be used for more accurate time counting. Alternatively, a timer implemented by dedicated hardware, such as an ASIC may be employed.

Further, whichever of a mark detection signal and a timer may be used to determine the latent image formation start timing, if it is unnecessary (or impossible) to form images corresponding to two sheets (two pages) simultaneously even when the longitudinal dimension of a recording material is smaller than half the circumference of the intermediate transfer belt 1517, image formation is performed in the same process as in the case where the longitudinal dimension of a recording material is not smaller than half the circumference of the intermediate transfer belt 1517.

Figure 21:
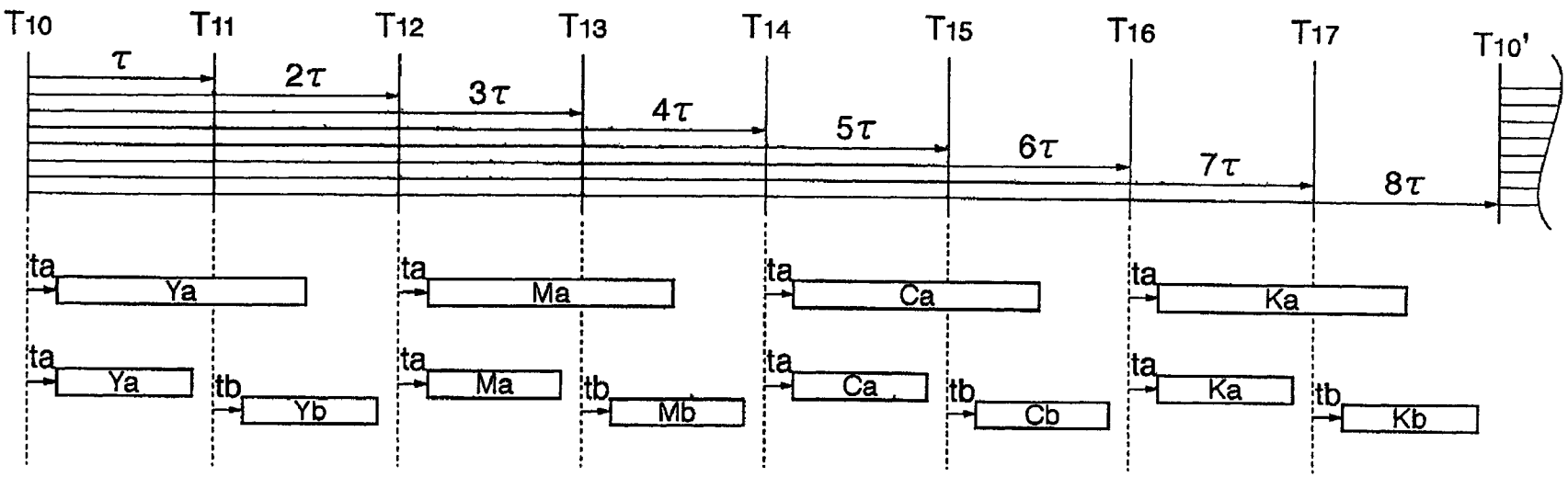
FIG. 21 is a timing diagram showing control of image formation timing based on counting of different predetermined time periods by eight timers.

Furthermore, as a method of determining latent image formation start timing using a timer, other various methods than the methods shown in FIGS. 19A and 19B can be employed. For example, it is possible for the CPU 1641 to simultaneously start a plurality of timers for counting respective time periods nτ (n=1 to 8), as shown in FIG. 21, to thereby determine image formation start timing T1*j*+ta (j=0, 2, 4, 6), or image formation start timing T1*j*+ta and T1*k*+tb (k=1, 3, 5, 7).

Figure 22:
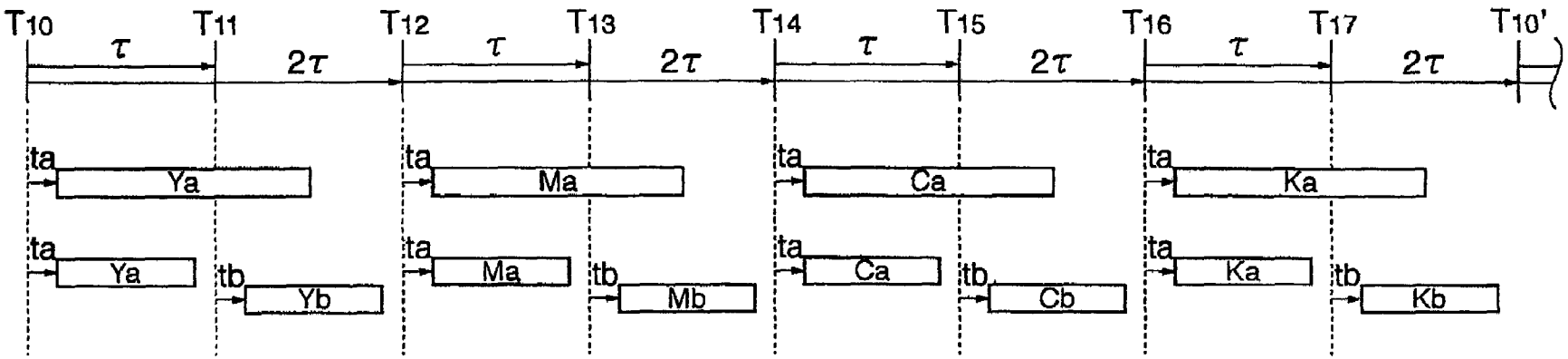
FIG. 22 is a timing diagram showing control of image formation timing based on counting of different predetermined time periods by two timers.
Figure 23A:
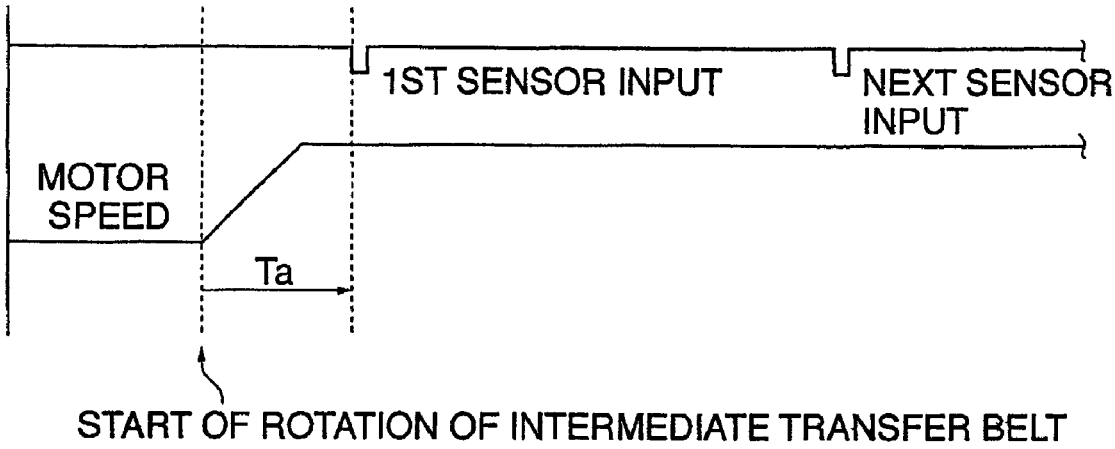
FIG. 23A is a diagram schematically showing the relationship between a stop position of the intermediate transfer belt and HP mark detection in the case where a time period between the start of motor rotation and detection of an HP mark is short.
Figure 23B:
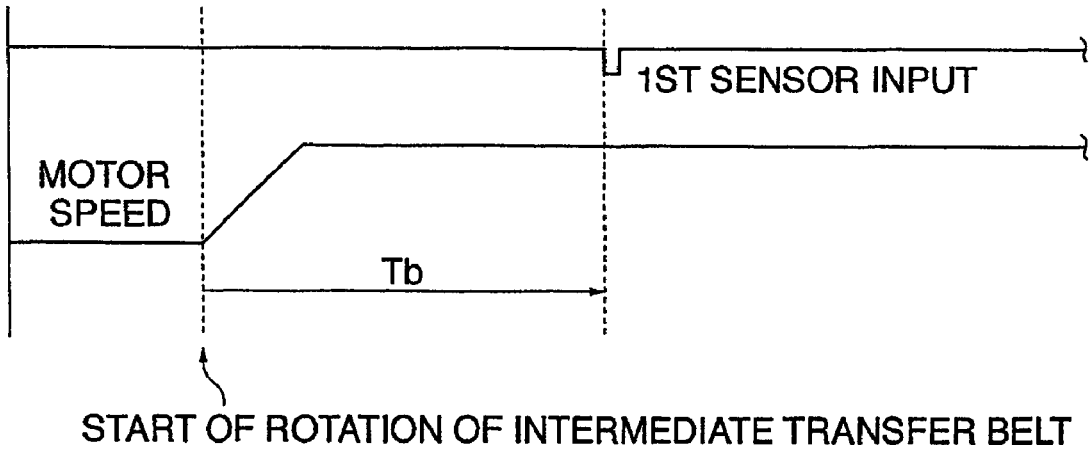
FIG. 23B is a diagram schematically showing the relationship between the stop position of the intermediate transfer member and HP mark detection in the case where a time period between the start of motor rotation and the HP mark detection is long.

Alternatively, as shown in FIG. 22, two timers for counting respective time periods nτ (n=1, 2) may be provided. The CPU 1641 starts the two timers in each rotation of the intermediate transfer belt 1517 to thereby determine the image formation start timing T1*j*+ta (j=0, 2, 4, 6), or the image formation start timing T1*j*+ta and T1*k*+tb (k=1, 3, 5, 7).

According to the timer-based methods of controlling image formation timing as shown in FIGS. 19A, 19B, 21, and 22, by setting the time T10 as a starting point to a time point immediately after stabilization of rotation of the motor for driving the intermediate transfer belt 1517, it is possible to quickly form an image on a recording material. To determine whether or not the rotation of the motor for driving the intermediate transfer belt 1517 has been stable, the speed of the intermediate transfer belt 1517 may be detected or a lock signal of the motor may be used. Further, the time T10 as a start point may be set to a time point at which a predetermined time period has elapsed which includes a time period required for stabilization of the rotation of the intermediate transfer belt 1517 after the start of image forming.

Figure 20:
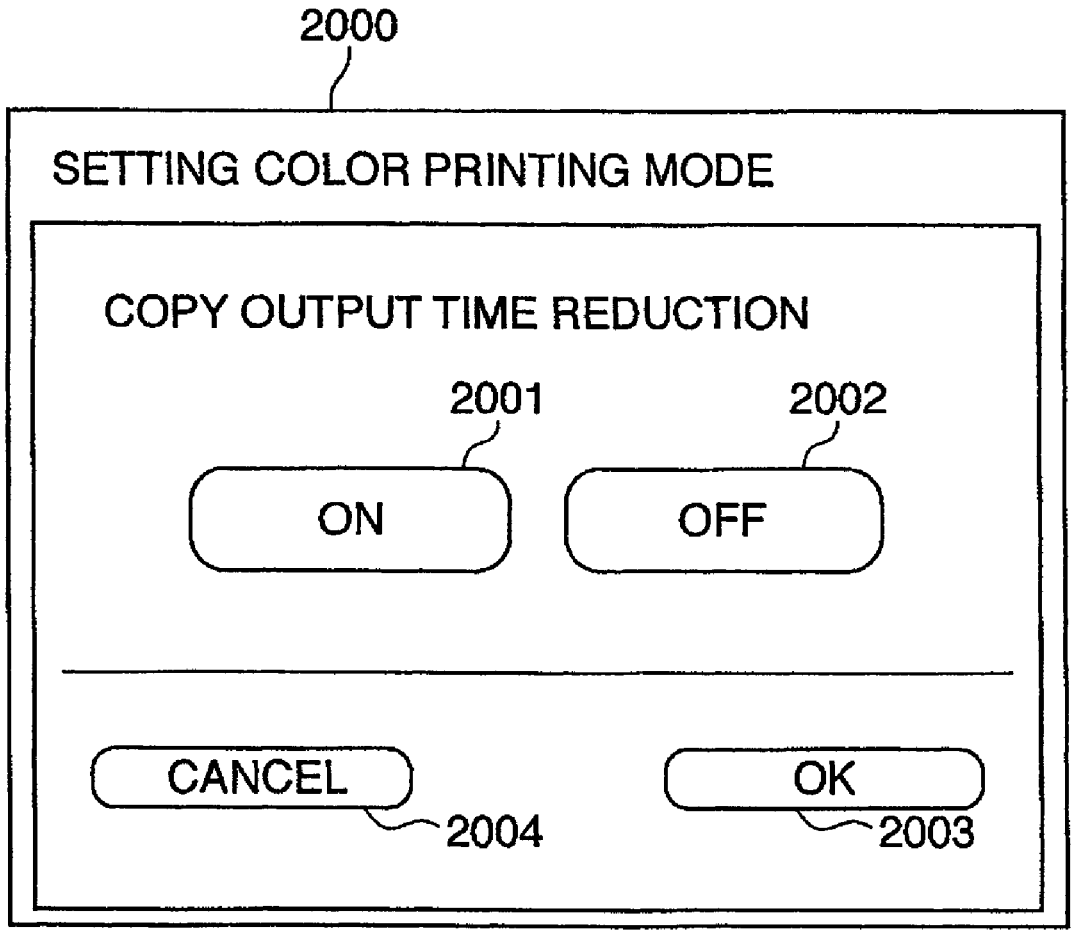
FIG. 20 is a view showing a screen for switching between the mark detection signal-based control of image formation timing and the control of image formation timing based on counting of the predetermined time period by the timer.

FIG. 20 shows one of user mode screens displayed when respective associated user mode keys, not shown, are pressed on the operating section 1660 appearing in FIG. 16. On the user mode screen 2000 shown in FIG. 20, it is possible to select between mark detection signal-based control and timer-based control, for controlling the image formation start timing. It should be noted that the user mode screens are user interface screens for setting operations corresponding to respective functions provided for the image forming apparatus 1500.

When an ON button 2001 is pressed on the user mode screen 2000 shown in FIG. 20, i.e. when the user selects a reduction mode in which a copy output time is shortened, the image formation start timing is controlled based on timer counting, as shown in FIGS. 19A, 19B, FIG. 21, or FIG. 22, so as to quickly start image forming operation. On the other hand, when an OFF button 2002 is pressed, the image formation start timing T1*j*+ta (j=0, 2, 4, 6) or the image formation start timing T1*j*+ta and T1*k*+tb (k=1, 3, 5, 7) is controlled based on the mark detection signal(s) as shown in FIG. 18A or 18B. An OK button 2003 finally determines pressing operation of the ON button 2001 or the OFF button 2002, and a cancel button 2004 cancels the pressing operation.

It should be noted that when neither the ON button 2001 nor the OFF button 2002 is pressed by the user on the user mode screen 2000, i.e. when a copy output time period is in a default state, the image formation start timing is controlled based on the mark detection signal. Further, a control method of controlling the image formation start timing based on timer counting can be used not only for a case where the image forming operation must be started quickly, but also for a case where the CPU 1641 causes a mark abnormality to be displayed and automatically switches to the timer-based control to cope with the trouble that the mark sensor 1701 cannot normally read the HP marks 1702 and 1703 due to stains or the like in the image forming apparatus 1500, or the mark detection signal is made abnormal by noise.

It is to be understood that the object of the present invention may also be accomplished by supplying a system or an apparatus with a storage medium in which a program code of software, which realizes the functions of any of the above described embodiments is stored, and causing a computer (or CPU or MPU) of the system or apparatus to read out and execute the program code stored in the storage medium.

In this case, the program code itself read from the storage medium realizes the functions of any of the above described embodiments, and therefore the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of any of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

This application claims priorities from Japanese Patent Application Nos. 2005-203633 and 2005-203634 both filed Jul. 12, 2005, which are hereby incorporated by reference herein.

What is claimed is:

1. An image forming apparatus comprising:

an image forming portion for forming an image on an image carrier, for primarily transferring the image on the image carrier onto an intermediate transfer member having a plurality of marks indicative of reference positions, to thereby form a color image, and for secondarily transferring the image on the intermediate transfer member onto a recording material to thereby carry out image formation;

a detecting portion for detecting the marks on the intermediate transfer member;

a controller for causing an image write reference signal, which is to be used to start image formation, to be generated based on an output from said detecting portion; and a determining portion for determining whether or not detection of the marks by said detecting portion is normal, wherein said controller causes the image write reference signal to be generated based on detection of ones of the marks which are determined to be normal by said determining portion, and causes an alternate signal, serving as the image write reference signal, to be generated in association with any of the marks which are determined to be abnormal.

2. An image forming apparatus as claimed in claim 1, wherein said controller causes the alternate signal to be generated based on detection of ones of the marks which are determined to be normal.

3. An image forming apparatus as claimed in claim 2, wherein the marks are provided at positions spaced apart by a distance corresponding to half an entire circumference of the intermediate transfer member, and wherein, in a case where the recording material has a longitudinal length less than half the entire circumference of the intermediate transfer member, said controller causes, in association with detection of ones of the marks which are determined to be abnormal by said determining portion, the alternate signal to be generated based on detection of ones of the marks which are determined to be normal and a time period corresponding to half the entire circumference of the intermediate transfer member.

4. An image forming apparatus as claimed in claim 1, wherein said controller permits generation of the alternate signal in response to selection of a specific mode, and causes the specific mode to be displayed.

5. An image forming apparatus as claimed in claim 1, wherein when said determining portion determines that detection of any of the marks is abnormal, said controller causes information notifying the determination to be displayed.

* * * * *